US011134819B2

(12) United States Patent
Li et al.

(10) Patent No.: US 11,134,819 B2
(45) Date of Patent: Oct. 5, 2021

(54) LIQUID CONTAINER AND AUTONOMOUS CLEANING ROBOT

(71) Applicant: Shenzhen Rock Times Technology Co., Ltd., Shenzhen (CN)

(72) Inventors: Xing Li, Shenzhen (CN); Song Peng, Shenzhen (CN); Youcheng Lu, Shenzhen (CN)

(73) Assignee: SHENZHEN ROCK TIMES TECHNOLOGY CO., LTD., Shenzhen (CN)

( * ) Notice: Subject to any disclaimer, the term of this patent is extended or adjusted under 35 U.S.C. 154(b) by 294 days.

(21) Appl. No.: 16/330,388

(22) PCT Filed: Nov. 30, 2017

(86) PCT No.: PCT/CN2017/113998

§ 371 (c)(1),
(2) Date: Mar. 5, 2019

(87) PCT Pub. No.: WO2018/137407

PCT Pub. Date: Aug. 2, 2018

(65) Prior Publication Data

US 2020/0323413 A1 Oct. 15, 2020

(30) Foreign Application Priority Data

Jan. 26, 2017 (CN) ..... 201710061574.3

(51) Int. Cl.
*A47L 11/28* (2006.01)
*A47L 9/06* (2006.01)
(Continued)

(52) U.S. Cl.
CPC ..... *A47L 11/28* (2013.01); *A47L 9/0477* (2013.01); *A47L 9/0686* (2013.01);
(Continued)

(58) Field of Classification Search
CPC .. A47L 11/28; A47L 11/4016; A47L 11/4072; A47L 9/0477; A47L 9/0686;
(Continued)

(56) References Cited

U.S. PATENT DOCUMENTS 10,292,553 B1 * 5/2019 Ebrahimi Afrouzi ..... A47L 5/00

FOREIGN PATENT DOCUMENTS

CN 103799924 A 5/2014
CN 204133376 U 2/2015
(Continued)

OTHER PUBLICATIONS

International Search Report issued in corresponding International application No. PCT/CN2017/113998, dated Mar. 7, 2018(10 pages).

*Primary Examiner* — David Redding

(57) ABSTRACT

The present application provides a liquid container and an autonomous cleaning robot. The liquid container may include a container case and a water outlet filter. The container case may define a water outlet (321) thereon and a liquid accommodating room therein. The water outlet communicates with the liquid accommodating room in the container case. The water outlet filter is mounted on the water outlet. The water outlet filter is configured to regulate the rate of the water outlet. The rate of the liquid container is better.

20 Claims, 20 Drawing Sheets

(51) Int. Cl.
*A47L 11/40* (2006.01)
*A47L 9/04* (2006.01)

(52) U.S. Cl.
CPC ..... *A47L 11/4005* (2013.01); *A47L 11/4016* (2013.01); *A47L 11/4027* (2013.01); *A47L 11/4041* (2013.01); *A47L 11/4058* (2013.01); *A47L 11/4072* (2013.01); *A47L 11/4083* (2013.01); *A47L 11/4088* (2013.01); *A47L 2201/04* (2013.01); *A47L 2201/06* (2013.01)

(58) Field of Classification Search
CPC ..... A47L 11/4005; A47L 11/4027; A47L 11/4041; A47L 11/4058; A47L 11/4083; A47L 11/4088; A47L 2201/04; A47L 2201/06; A47L 2201/00; A47L 11/4036; A47L 11/408; A47L 9/0466; A47L 11/4094
See application file for complete search history.

(56) References Cited

FOREIGN PATENT DOCUMENTS

| | | | |
|---|---|---|---|
| CN | 204813712 | U | 12/2015 |
| DE | 102015104247 | A1 | 9/2016 |
| EP | 1058958 | A1 | 12/2000 |
| KR | 20100006151 | A | 1/2010 |

* cited by examiner

LIQUID CONTAINER AND AUTONOMOUS CLEANING ROBOT

CROSS-REFERENCE TO RELATED APPLICATION

This application claims priority to a Chinese patent application No. 2017100615743, titled "AUTONOMOUS CLEANING ROBOT" and filed on Jan. 26, 2017. The entirety of the above-mentioned application is hereby incorporated by reference herein.

TECHNIQUE FIELD

The present disclosure relates to a cleaning equipment, and more particularly, to a liquid container and autonomous cleaning robot.

BACKGROUND

With the development of technology, a variety of autonomous cleaning robots have been appeared. For example, automatic sweeping robots, automatic mopping robots and so on. Autonomous cleaning robot can automatically and user-friendly perform cleaning operations. Taking the automatic sweeping robot as an example, the automatic sweeping robot can automatic clear an aria by scraping and vacuum cleaning technology. The scraping operation can be achieved by automatically cleaning the bottom of the device with a scraper and a roller brush.

For an autonomous cleaning robot with a mopping function, it is often need to set up a water tank on the robot to provide the water source required for the mopping. Normally, the water tank is connected to the robot at a bottom thereof. The bottom of the robot always needs to be turned upside down to install or disassemble the water tank therefrom. It is likely to cause collision or damage of the top of the robot, and easy to damage the sensor installed on the top of the robot, resulting in greater economic losses. In addition, if the water tank has a leak, when the water tank is installed or disassembled, the leakage of water may flow into the robot through a gap of the bottom, resulting in damage to internal circuits and components and irreparable problems.

SUMMARY

Embodiments of the present disclosure provide a liquid container and an autonomous cleaning robot, to solve the problem of the rate of the water tank not working well.

In order to achieve the above object, embodiments of the present disclosure provide a liquid container. The liquid container may include a container case and a water outlet filter. The container case may define a water outlet thereon and a liquid accommodating room therein. The water outlet communicates with the liquid accommodating room in the container case. The water outlet filter is mounted on the water outlet. The water outlet filter is configured to regulate the rate of the liquid dispensed from the liquid accommodating room.

Optionally, the water outlet filter may include a filter element. The filter element is plugged into the water outlet so as to, block the water outlet.

Optionally, the water outlet filter may include a filter mounting frame and the filter element. The filter mounting frame is detachably mounted in the water outlet. The filter mounting frame defines a receiving hole. The receiving hole is through the filter mounting frame, and the filter element is detachably filled in the receiving hole.

Optionally, the water outlet filter may include a stop gasket. The stop gasket is provided on one end of the filter mounting frame.

Optionally, the container case defines a recess thereon. The recess is set around the water outlet. The stop gasket is located in the recess.

Optionally, the filter mounting frame defines a water inlet thereon. The water inlet communicates with the receiving hole and the liquid accommodating room.

Optionally, a plurality of the water inlets is defined on the filter mounting frame. The plurality of water inlets is spaced apart from each other in the circumferential direction of the filter mounting frame.

Optionally, the liquid container includes an obstacle-assisting wheel. The obstacle-assisting wheel is rotatable mounted on the container case.

Optionally, the obstacle-assisting wheel protrudes out from the surface of a position on the container case.

According to another aspect of the present, embodiments of the present disclosure provide an autonomous cleaning robot. The autonomous cleaning robot may include a main body and a cleaning assembly. The cleaning assembly is mounted on the main body. The cleaning assembly includes a first cleaning subassembly which is detachably mounted on the main body. When the first cleaning subassembly is loaded or removed from the main body, the first cleaning subassembly moves in the forward direction or the backward direction of the main body. The first cleaning subassembly includes a liquid container mentioned above.

Optionally, the obstacle-assisting wheel is located at an bottom end of the liquid containing case in a backward direction thereof.

Optionally, the autonomous cleaning robot includes a driving wheel module. The driving wheel module includes a driving wheel rotatable mounted on the main body. When the main body is in the horizontal state, a lowest point of the obstacle-assisting wheel on the liquid container is higher than a lowest point of the driving wheel.

Optionally, the first cleaning subassembly includes a cleaning cloth. The cleaning cloth is disposed on a side of the container case. The obstacle-assisting wheel is mounted on the side of the container case. The cleaning cloth defines an opening to expose the obstacle-assisting wheel therefrom.

Optionally, the cleaning cloth is detachably provided on the liquid container. A first guide portion is mounted on the cleaning cloth. A second guide portion is provided on the liquid container. The first guide portion and the second guide portion are engaged with each other to limit the installation direction of the cleaning cloth.

Optionally, the first guide portion includes a guiding groove. The second guide portion includes a guide bar engaged with the guiding groove. The guide bar can be plugged into the guiding groove to limit the movement of the cleaning cloth relative to the liquid container.

Optionally, the first guide portion includes a guiding strip. The second guide portion includes a mounting groove. The guiding strip can penetrate and be fixed in the mounting groove to limit the movement of the cleaning cloth relative to the liquid container.

Optionally, the guiding strip is fixed to the cleaning cloth by means of a connecting member. A notch is provided on the mounting groove to avoid the connecting member. An opening is provided on a first end of the mounting groove. The guiding strip passes through the opening into the mounting groove. The second end of the mounting groove is provided with an stop structure to stop the guiding strip escaping from the mounting groove.

Optionally, the cleaning cloth is semicircular. The cleaning cloth includes a water seepage zone, a decontamination zone and a water absorption zone in turn.

The liquid container of the embodiment of the present disclosure can regulate the rate of the liquid container by setting the water outlet filter on the water outlet of the container case. The liquid container adopts the water outlet filter and uses the filter structure to regulate the rate to solve problems of the prior art. Compared with a water seepage cloth arranged in the water tank, with one end arranged in the water storage space and the other end arranged at the outlet, guiding the water in the water tank to the outlet through capillary action, using the filter structure to control the water discharged can solve the problem of the water flow rate not easy to control of the water seepage cloth. The water seepage cloth needs to be completely set in the container case body, so the replacement of the water seepage cloth is inconvenient and the cost is high, and the water tank is required to be disassembled. The water outlet filter of the liquid container of the embodiment of the present disclosure set in the water outlet and is easy to be disassembled.

Figure 1:
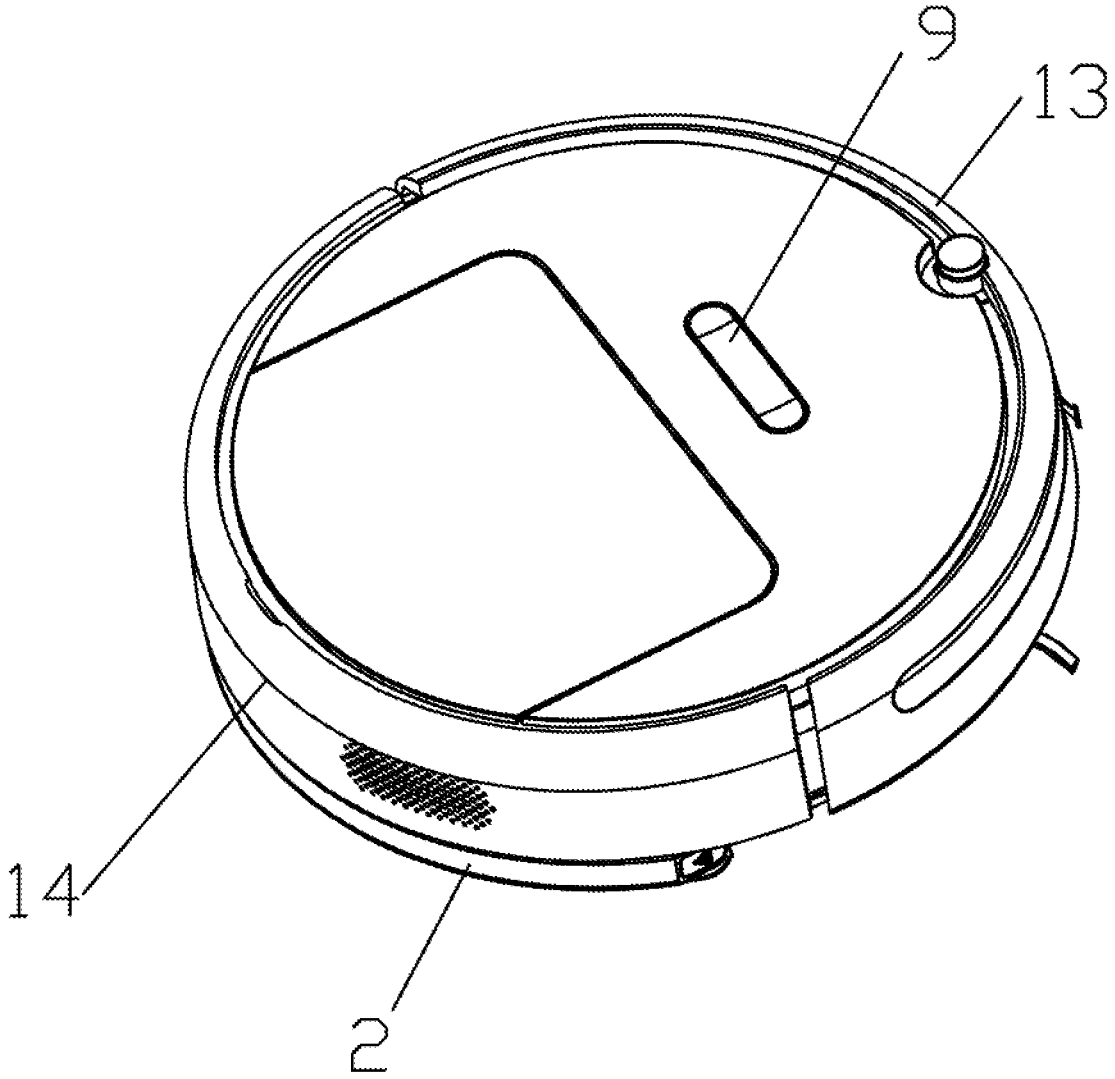
FIG. 1 illustrates a schematic view of a first view of an autonomous cleaning robot, in accordance with embodiments of the present disclosure.

LIST OF REFERENCE NUMERALS main body 1; chassis 11; the first guiding groove 111; the first buckle 112; protrusion structure 113; forward part 13; backward part 14; the first cleaning subassembly 2; liquid container 3; upper cover 31; the first guiding ridge 311; opening 312; stop protrusion 313; lower cover 32; water outlet 321; the obstacle-assisting wheel 322; mounting groove 323; adhesive structure 324; engagement control member 33; the second buckle 331; mounting frame 332; hole wall 332*a*; operating member 333; elastic piece 334; water outlet filter 34; filter mounting frame 341; water inlet 341*a*; filter element 342; stop gasket 343; water injection port 35; connecting rod 381; spring 382; toggle piece 383; buckle 384; cleaning cloth 4; outer layer 41; middle layer 42; inner layer 43; guiding strip 44; cliff sensor 51; roller brush 61; side brush 62; driving wheel module 71; driven wheel 72; human-computer interaction system 9.

DETAILED DESCRIPTION OF PREFERRED EMBODIMENTS

As the following, the liquid container and the intelligent cleaning apparatus of the embodiment of the present invention will be described in detail with attached drawings.

Definition of Nouns

Use of the terminology "forward" refers to primary direction of motion of the autonomous cleaning robot.

Use of the terminology "backward" refers to opposite direction of primary direction of motion of the autonomous cleaning robot.

According to embodiments of the present disclosure, the present provide a liquid container. The liquid container may include a container case. A water outlet 321 is defined at the container case. The water outlet 321 communicates with the liquid accommodating room in the container case. A water outlet filter 34 is defined on the water outlet 321. The water outlet filter 34 is configured to regulate the rate of the water outlet. The filter structure of the water outlet filter 34 is used to achieve effluence control by means of setting the water outlet filter 34 on the water outlet. The liquid container adopts the water outlet filter and uses the filter structure to regulate the rate to solve problems of the prior art. Compared with a water seepage cloth arranged in the water tank, with one end arranged in the water storage space and the other end arranged at the outlet, guiding the water in the water tank to the outlet through capillary action, using the filter structure to control the water discharged can solve the problem of the water flow rate not easy to control of the water seepage cloth. The water seepage cloth needs to be completely set in the container case body, so the replacement of the water seepage cloth is inconvenient and the cost is high, and the water tank is required to be disassembled. The filter structure is removable provided in the outlet 321 for easier replacement.

In the present embodiments, the water seepage cloth in the liquid container is omitted. Only using the water outlet filter 34 to control the effluence, the water control can be better.

In the present embodiments, the liquid container is used in the autonomous cleaning robot, such as a sweeping robot. The liquid container is configured to hold the cleaning fluid (e.g., water) of the autonomous cleaning robot. Of course, in other embodiments, the liquid container can also be used in other suitable environments.

Optionally, the container case may include an upper cover 31 and a lower cover 32. The upper cover 31 is connected to the lower cover 32. The water outlet 321 is provided on the lower cover 32.

Optionally, there area plurality of water outlets 321. The plurality of water outlet 321 is provided on the container case spaced from each other. According to different needs of the amount of water, the number of the water outlets 321 can be different. Two water outlets 321 can ensure the amount of water and avoid frequent water needs caused by water flowing too fast. Of cause, it is also possible to control the amount of water of the single water outlet 321 by adjusting the size of the water outlet 321.

Optionally, the water outlet filter 34 may include a filter element 342. The filter element 342 is plugged into the water outlet 321, and blocks the water outlet 321. The liquid in the liquid container must pass through the filter element 342 to flow out. By controlling the permeation rate of the filter element 342, it is possible to regulate the rate and to solve the problem of the water flow rate not easy to control of the water seepage cloth.

Figure 24:
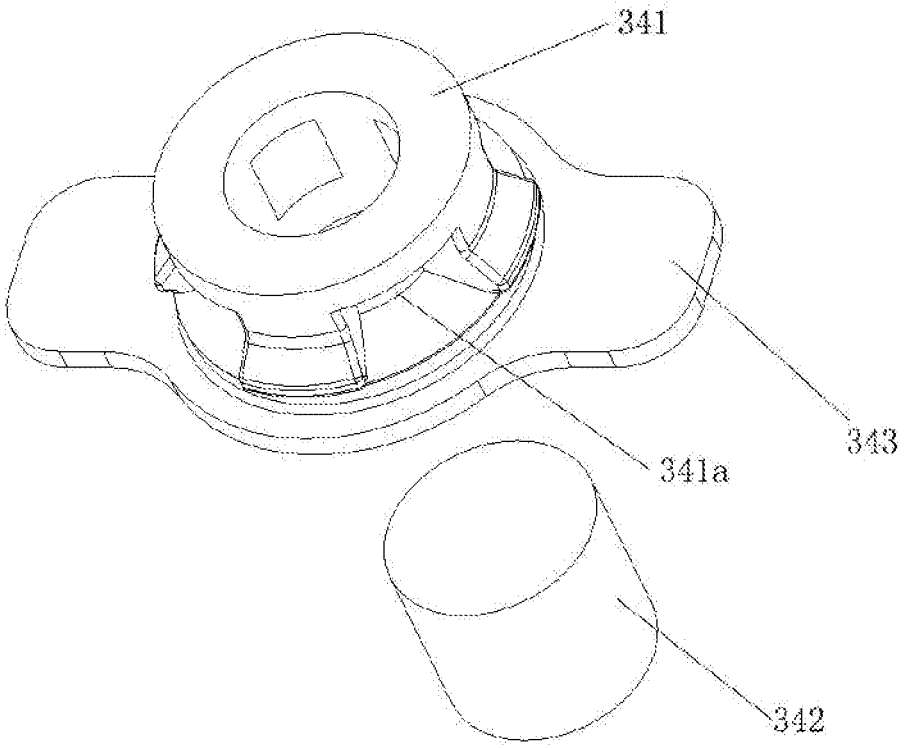
FIG. 24 illustrates a schematic view of a first view of a water outlet filter of an autonomous cleaning robot, in accordance with embodiments of the present disclosure.
Figure 25:
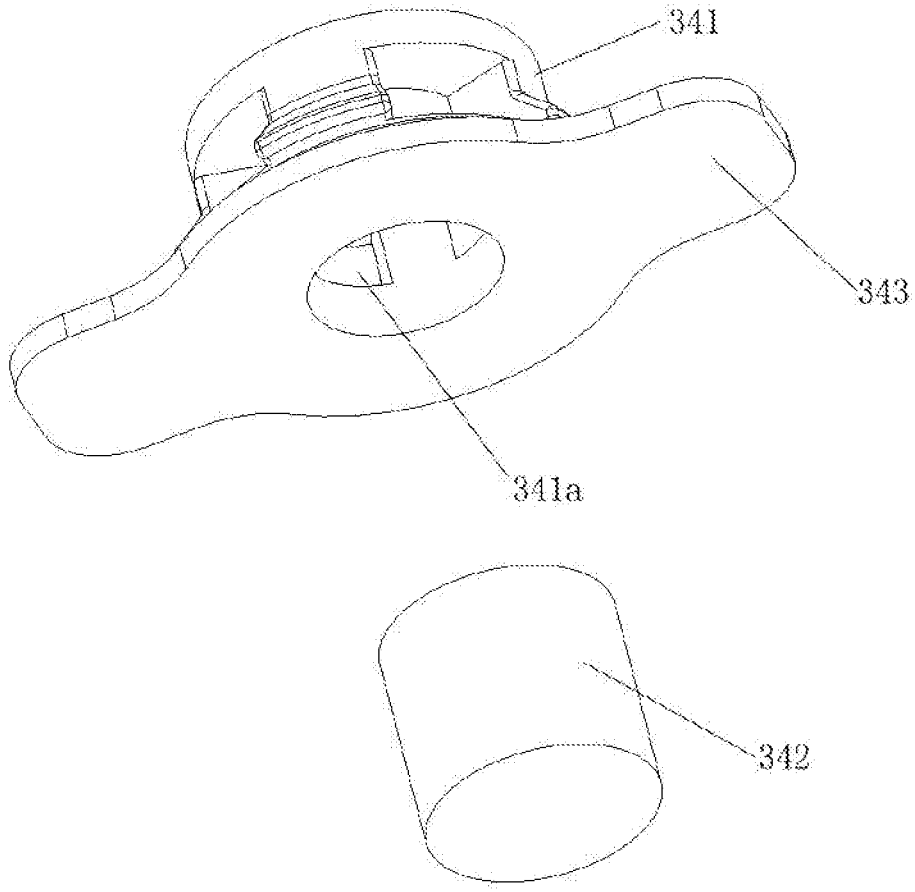
FIG. 25 illustrates a schematic view of a second view of a water outlet filter of an autonomous cleaning robot, in accordance with embodiments of the present disclosure.
Figure 26:
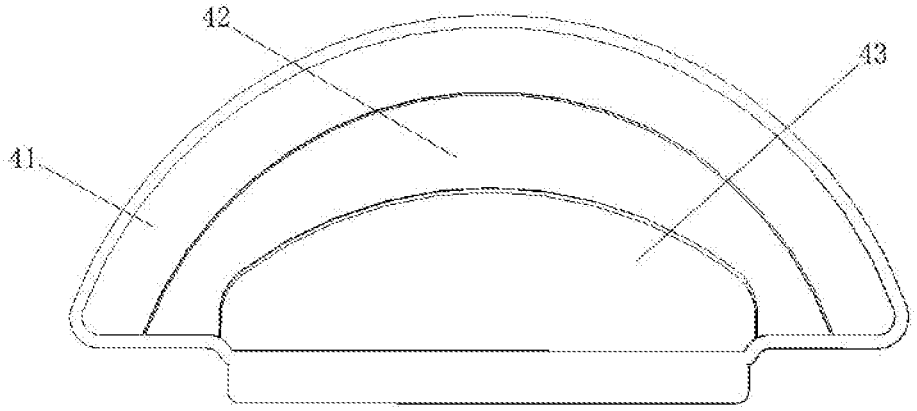
FIG. 26 illustrates a schematic view of a cleaning cloth of an autonomous cleaning robot, in accordance with embodiments of the present disclosure.

Optionally, the water outlet filter 34 may include a filter mounting frame 341 and the filter element 342. The filter mounting frame 341 is detachably mounted in the water outlet 321. A receiving hole through the filter mounting frame 341 is defined at the filter mounting frame 341. The filter element 342 is filled in the receiving hole. FIGS. 24 and 25 show the water outlet filter 34 using a such structure. After the filter mounting frame 341 is mounted to the water outlet 321 of the lower cover 32, the amount of water can be regulated by the filter element 342. Since the filter mounting frame 341 is plugged into the water outlet 321 from the outside of the lower cover 32 (the side remote from the upper cover 31), the water outlet filter 34 can be replaced without removing the accommodating case body, so the replacement is more convenient. While the control of the amount of water only need to select the different permeability of the filter element 342, the water control is more accurate and good, thus ensuring the cleaning effect.

In order to facilitate the water inside the container case flow into the filter element 342, a plurality of water inlets 341*a* are defined on the filter mounting frame 341. The water inlet 341*a* communicates with the receiving hole and the liquid accommodating room. Optionally, the water inlets 341*a* are defined on the filter mounting frame 341. The water inlets 341*a* are spaced apart from each other in the circumferential direction of the filter mounting frame 341.

Certainly, in other embodiments, the water outlet filter 34 may include only the filter element 342, as long as the amount of water can be regulated.

Optionally, the number of the water outlet filter 34 is two or more. Each water outlet filter 34 corresponds to a water outlet 321. The number of the water outlet filter 34 may be appropriately selected depending on the zone of the cleaning cloth 4 and the required humidity. More preferably, the water outlet filter 34 is two, and the distance between the two is 10 mm to 350 mm to ensure uniform wetting of the cleaning cloth 4. More preferably, the distance between the two water control filters is 80 mm to 90 mm. The water outlet filter 34 may include a stop gasket 343. The stop gasket 343 is provided on one end of the filter mounting frame 341. A recess is formed at the container case and formed around the water outlet 321. The stop gasket 343 is located in the recess. Optionally, the water outlet filter 34 may further include the stop gasket 343 (which may be made of a rubber material). The stop gasket 343 is fixed to one end of the filter mounting frame 341 far away from the upper cover 31. A side of the lower cover 32, far away from the upper cover 31, defines a recess for receiving the stop gasket 343. On the one hand, the stop gasket 343 can preventing the liquid from flowing out of the gap between the water outlet and the water outlet filter 34, and on the other hand, an operation position can be provided for easily removing the water outlet filter 34. The water outlet filter 34 is used to control the amount of water discharged, making the replacement more convenient. And according to the needs in different environments, the filter element 342 with different materials make the amount of water discharged be controllable, and user-friendly choice.

Optionally, in order to improve the climbing and obstructing ability of the autonomous cleaning robot, enable the autonomous cleaning robot adapt to more different using environments, the liquid container may include an obstacle-assisting wheel 322. The obstacle-assisting wheel 322 is rotatable mounted on the container case. The obstacle-assisting wheel 322 protrudes from the surface of the container case. For ease of understanding, the effect of the obstacle-assisting wheel 322 will be described in connection with autonomous cleaning robot to which it is applied.

According to another aspect of an embodiment of the present invention, the present invention provides an autonomous cleaning robot. The autonomous cleaning robot may include a main body 1 and a cleaning assembly. The main body 1 is configured to carry other structures. The cleaning assembly is mounted on the main body 1. The cleaning assembly may include a first cleaning subassembly 2 which is detachably mounted on the main body 1. When the first cleaning subassembly 2 is loaded or removed from the main body 1, the first cleaning subassembly 2 moves in the forward direction or the backward direction of the main body 1. The first cleaning subassembly 2 may include a liquid container 3 mentioned above. When the first cleaning subassembly 2 is mounted on the main body 1 or is removed from the main body 1, the first cleaning subassembly 2 is moved in the forward direction (or the backward direction) of the main body 1, so that the loading and removal of the first cleaning subassembly 2 is more convenient, and the problem that the bottom of the robot always needs to be turned upside down to install or disassemble the water tank therefrom can be solved. Normally, the forward direction of the main body 1 is in the horizontal direction, so that the loading and removal of the first cleaning subassembly 2 is more convenient. The liquid container 3 having the above-described structure makes it more effective to deliver water, thereby ensuring a cleaning effect.

Figure 2:
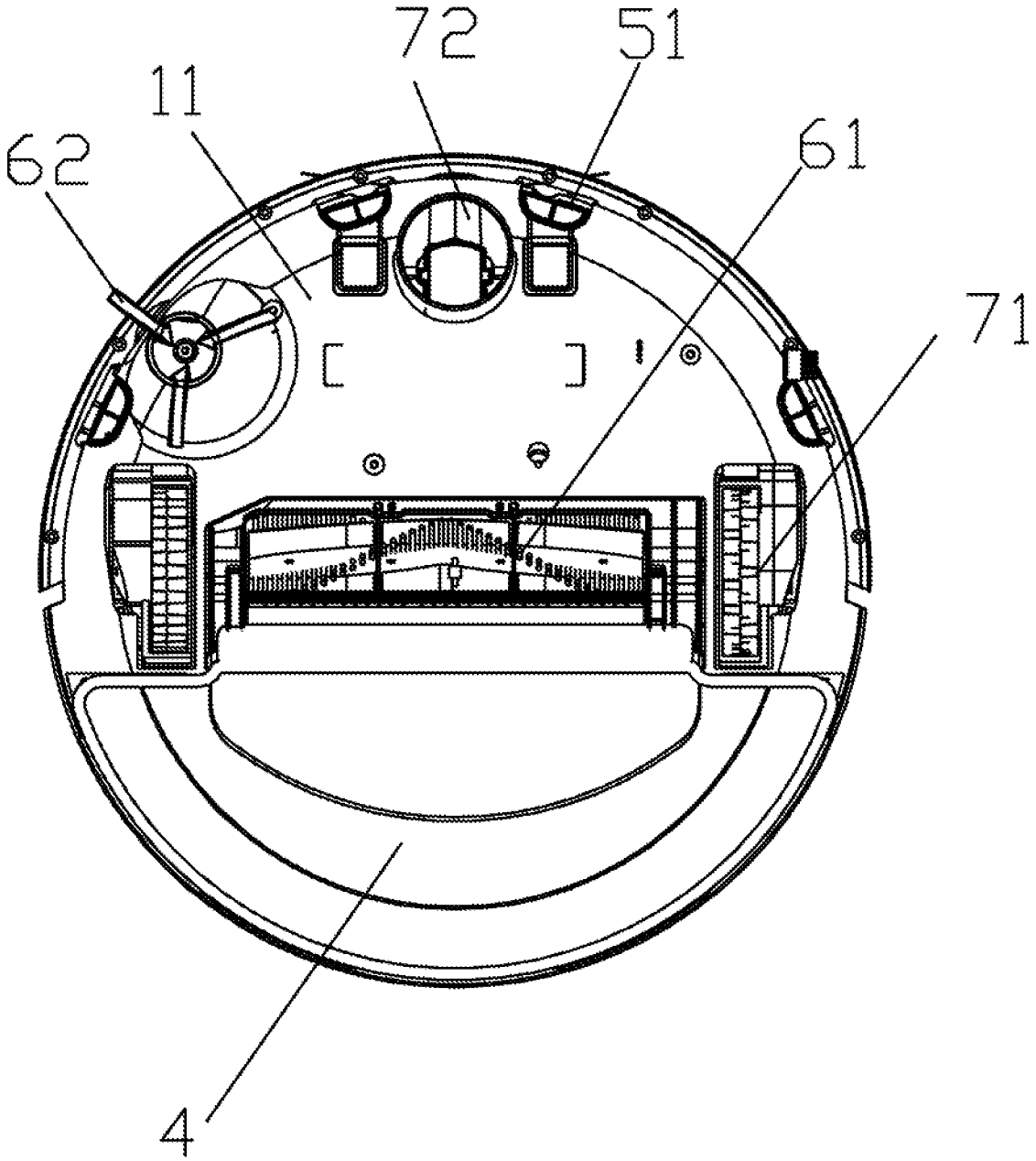
FIG. 2 illustrates a schematic view of a second view of an autonomous cleaning robot, in accordance with embodiments of the present disclosure.
Figure 3:
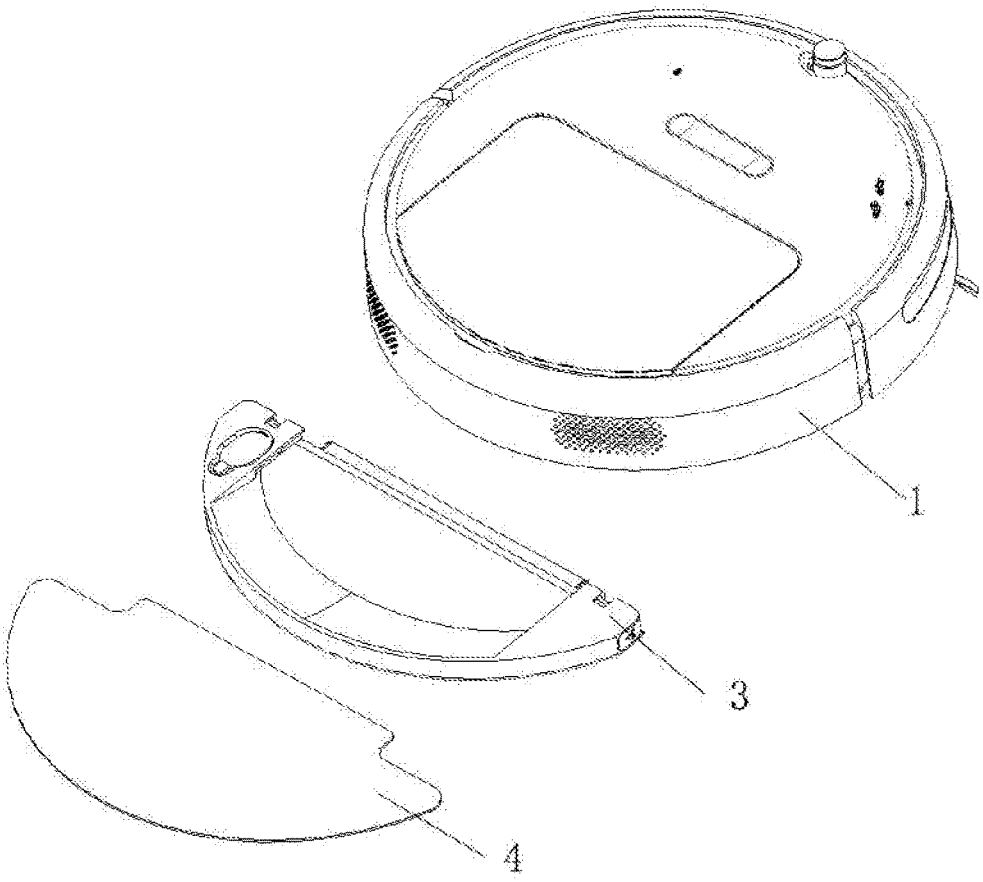
FIG. 3 illustrates a schematic view of a first view of a main body three-dimensional structure of a first perspective view of a main body and a first cleaning subassembly of an autonomous cleaning robot, in accordance with embodiments of the present disclosure.
Figure 4:
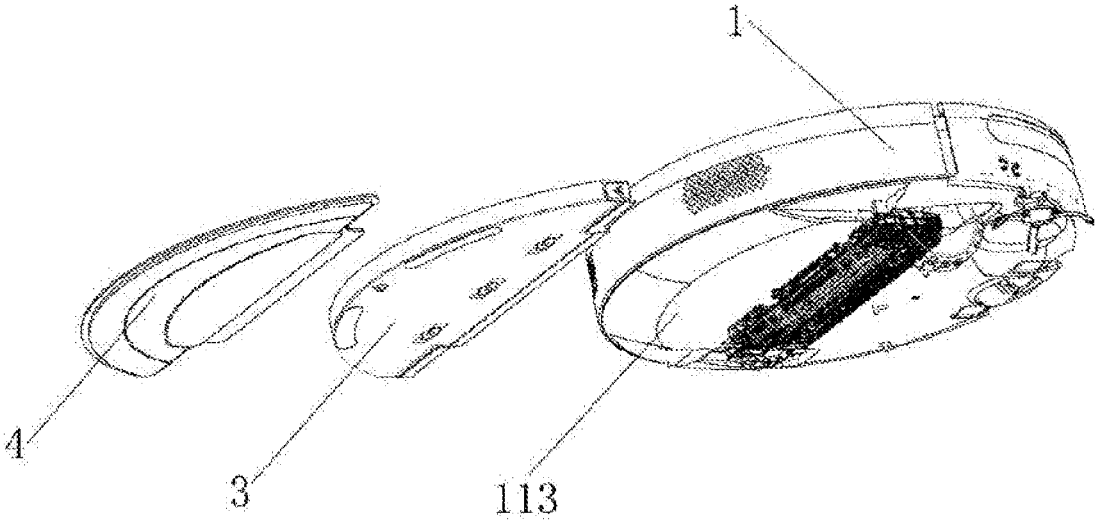
FIG. 4 illustrates a schematic view of a second view of a main body and a first cleaning subassembly of an autonomous cleaning robot, in accordance with embodiments of the present disclosure.
Figure 5:
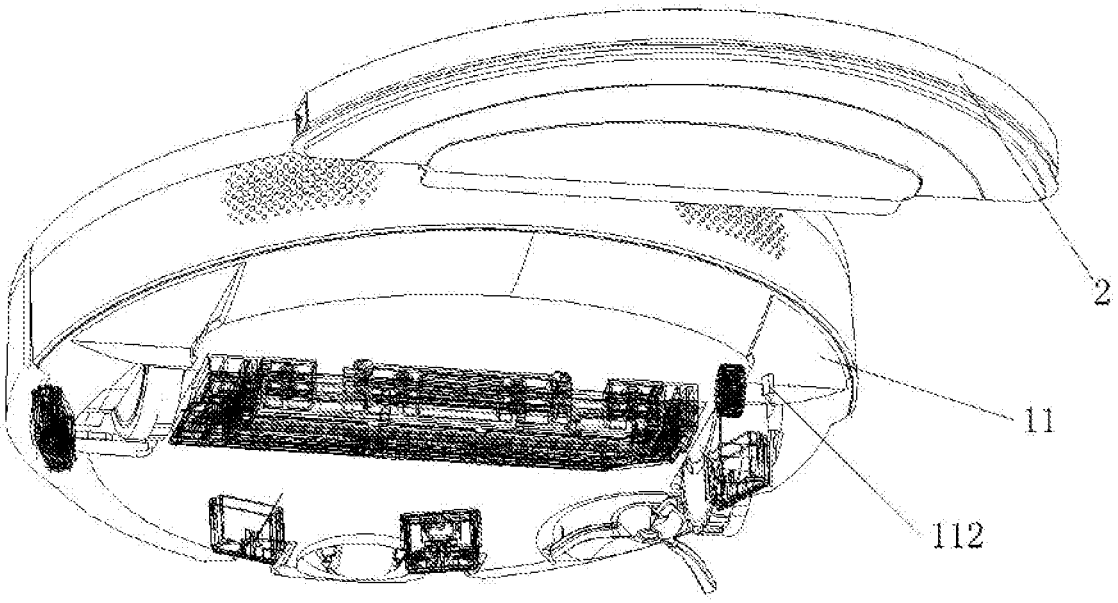
FIG. 5 illustrates a schematic view of a third view of a main body and a first cleaning subassembly of an autonomous cleaning robot, in accordance with embodiments of the present disclosure.
Figure 6:
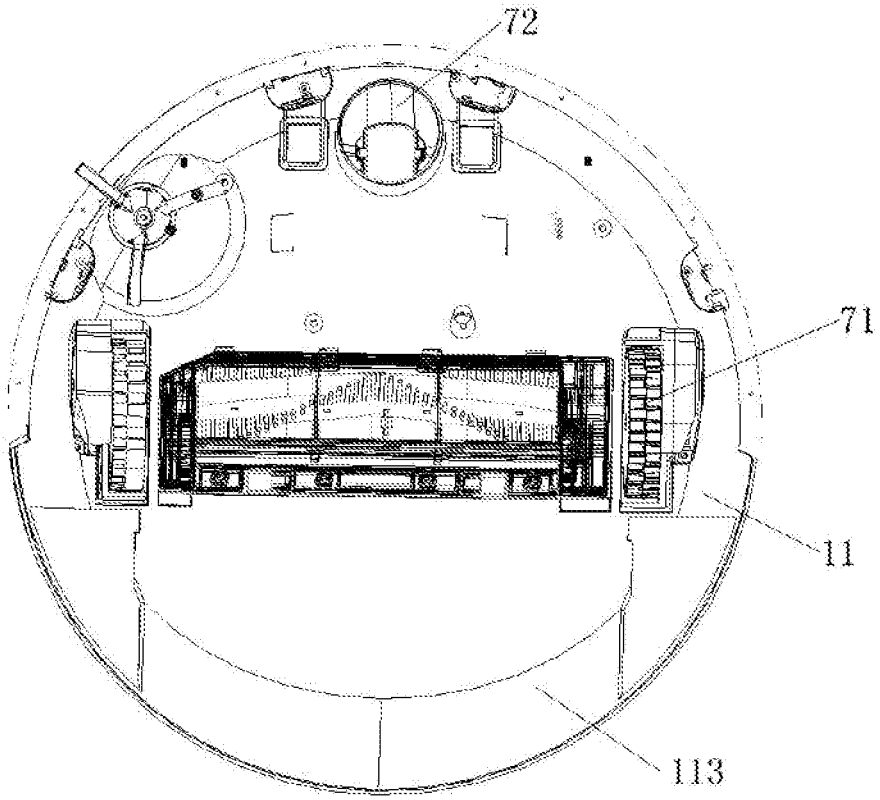
FIG. 6 illustrates a bottom view of a main body of an autonomous cleaning robot, in accordance with embodiments of the present disclosure.

As shown in FIGS. 1 and 2, the autonomous cleaning robot may be, but is not limited to, a smart sweeping robot, a solar panel robot or a building exterior cleaning robot. The embodiments of the present disclosure will be described with reference to a smart sweeping robot.

The autonomous cleaning robot may include a sensing system, a control system (not shown), a drive system, an energy system and a human-computer interaction system 9, in addition to the main body 1 and the cleaning assembly. The main parts of the autonomous cleaning robot will be described in detail below.

The main body 1 may include an upper cover, a forward part 13, a backward part 14, a chassis 11, and the like. The main body 1 has an approximately cylindrical configuration with minimal height (both front and rear are circular shape). The main body 1 may have other shapes, including but not limited to an approximately D-shaped shape with a front square and a rear circle.

The sensing system includes a position determining device located above the main body 1, a buffer located at the forward part 13 of the main body 1, cliff sensor 51, ultrasonic sensor, infrared sensor, magnetometer, accelerometer, gyroscope, odometer and other sensing devices. These sensing devices provide the control system with various location information and motion status information for the machine. The position determining device includes, but is not limited to, an infrared transmitting and receiving device, a camera, a laser distance measuring device (LDS).

The cleaning assembly includes a dry-cleaning section and a wet-cleaning section. Wherein, the wet cleaning section is the first cleaning subassembly 2. The wet-cleaning section is configured to wipe the surface (such as the ground) by the cleaning cloth 4 containing the cleaning solution. The dry-cleaning section is the second cleaning subassembly. The dry-cleaning section is configured to clean the fixed particle contaminants on the cleaned surface by cleaning brush and other structures.

The main cleaning function of the dry-cleaning section is derived from the second cleaning section including a roller brush 61, the dust cartridge, the fan, the air outlet, and the connecting member between the four parts.

The roller brush 61 has a certain interference with the ground, sweeps dusts on the floor and rolls it in front of the suction port between the roller brush 61 and the dust cartridge. And then the dusts are sucked into the dust cartridge by the suction gas generated by the fan and through the dust cartridge. The dust removal capacity of the sweeping machine can be characterized by the dust pick up efficiency (DPU)

The DPU is influenced by the structure and material of the roller brush 61, influenced by the wind power utilization ratio of a duct formed by the suction port, the fan, the dust cartridge, the air outlet, and the connecting member therebetween, and influenced by the type and power of the fan. Compared to ordinary plug-in vacuum cleaner, the improvement of dust removal capacity is more meaningful for cleaning robots with limited energy resources. The improvement of dust removal capacity directly and effectively reduces the energy requirements. In other words, the robot could clean the 80-square-meter ground previously in case of one charge, and now, the robot can evolve into cleaning 100 square meters or more in case of one charge. Reducing the number of charges makes the battery life greatly increase, and makes the frequency at which the user changes the battery increase. More intuitive and important, the improvement of dust removal capacity is the most obvious and important user experience. The user will directly find out whether the cleaning and wiping are clean or not. The dry-cleaning system may also include a side brush 62 having a rotating shaft. The rotary shaft is at an angle relative to the ground. The rotary shaft is configured to move the debris into the cleaning zone of the roller brush 61 of the second cleaning section.

As the wet-cleaning subassembly, the first cleaning subassembly 2 may mainly include the abovementioned liquid container 3 and cleaning cloth 4 and the like. The liquid container 3 is a base for supporting other components of the first cleaning subassembly 2. The cleaning cloth 4 is removable provided on the liquid container 3. The liquid in the liquid container 3 flows to the cleaning cloth 4. The cleaning cloth 4 wipes the ground after the ground is cleaned by the roller brush and the like.

The drive system is configured to drive the main body 1 and components mounted on the main body to move for automatic travel and cleaning. The drive system may include a driving wheel module 71. The drive system can issue a drive command to manipulate the robot to travel across the ground. The drive command is based on distance information and angle information, such as x, y and θ components. The driving wheel module 71 can simultaneously control the left wheel and the right wheel. In order to control the movement of the machine, Optionally the driving wheel module 71 includes a left driving wheel module and a right driving wheel module. The left driving wheel module and the right driving wheel module are opposed to each other along a lateral axis defined by the main body 1. The robot may include one or more driven wheels 72. The driven wheels include, but is not limited to, a caster. So that the robot can move more stably or stronger on the ground.

The driving wheel module 71 may include a travel wheel, a drive motor and a control circuit for controlling the drive motor. The driving wheel module 71 may also be connected to a circuit for measuring the drive current and an odometer. The driving wheel module 71 is detachably connected to the main body 1 for easy disassembly and maintenance. The driving wheel may have an offset drop suspension system. The driving wheel is movably fastened, for example, rotatable attached, to the main body 1 and receives a spring offset that is biased downward and away from the main body 1. The spring offset allows the driving wheel to maintain contact and traction with the ground with a certain ground force. At the same time the robots cleaning elements (such as roller brush, etc.) also contact the ground with a certain pressure.

The forward part 13 of the main body 1 may carry a buffer. When the driving wheel module 71 drives the robot to travel on the ground during cleaning, the buffer detects one or more events in the travel path of the robot via a sensor system, such as an infrared sensor. The robot may control the driving wheel module 71 to respond to an event, such as away from an obstacle, by events detected by the buffer, such as an obstacle, a wall.

The control system is provided on the circuit board in the main body 1. The control system may include a temporary memory and a communication computing processor. The temporary memory may include a hard disk, a flash memory and a random-access memory. The communication computing processor may include a central processing unit and an application processor. The application processor can draw an instant map of the environment in which the robot is located, based on the obstacle information fed back by the laser distance measuring device and the positioning algorithm, such as SLAM. The distance information and velocity information fed back by the sensor, such as the buffer, the cliff sensor 51, the ultrasonic sensor, the infrared sensor, the magnetometer, the accelerometer, the gyroscope, the odometer and so on, are used to determine the current working state of the sweeping machine. The working state of the sweeping machine may include crossing the threshold, walking on the carpet, at the cliff, above or below stuck, the dust cartridge full, picked up, etc. The application processor gives specific instructions for the next step for different situations. The robot is more in line with the requirements of the owner, and provides a better user experience. Furthermore, the control system can plan the most efficient cleaning path and cleaning method based on real-time map information drawn by SLAM, which greatly improves the cleaning efficiency of the robot.

The energy system may include a rechargeable battery, such as a nickel-metal hydride battery and a lithium battery. The rechargeable battery can be coupled to a charging control circuit, a battery pack charging temperature detecting circuit and a battery under voltage monitoring circuit. The charging control circuit, the battery pack charging temperature detecting circuit and the battery under voltage monitoring circuit connected with the microcontroller control circuit. The host is charged by connecting to the charging pile provided on the side or the lower side of the host. If the exposed charging electrode is dusted, the plastic body around the electrode will melt and deform due to the accumulation of charge during the charging process, and even cause the electrode itself to be deformed and cannot continue to be charged normally.

The human-computer interaction system 9 includes buttons on the host panel and buttons are configured to select the function for user. The human-computer interaction system may also include a display screen and/or a light, and/or a speaker, the display, the light and the speaker are configured to show the user the status of the machine or a function selection. The human-computer interaction system may also include a mobile client application. For the path navigation type cleaning equipment, the mobile client can show the user the map of the equipment located, as well as the location of the equipment, and can provide users with more rich and user-friendly features.

In order to describe the behavior of the autonomous cleaning robot more clearly, directions are defined as follows. The autonomous cleaning robot can travel on the ground by various combinations of movements of the following three mutually perpendicular axes defined by the main body 1: a front and rear axis X (i.e., the axis in the direction of the forward part 13 and the backward part 14 of the main body 1), a lateral axis Y (i.e., the axis perpendicular to the axis X and the same horizontal as the axis X) and a center vertical axis Z (axis perpendicular to axis X and axis of axis Y). The forward direction of the front and rear axis X is defined as "forward", and the backward direction of the front and rear axis X is defined as "backward". The lateral axis Y extends along the axis defined by the center point of the driving wheel module 71 between the right wheel and the left wheel of the autonomous cleaning robot.

The autonomous cleaning robot can rotate around the Y axis. When the forward part of the autonomous cleaning robot is tilted upward and the backward part is tilted downward, it is defined as "up". When the forward part of the robot is tilted downward and the backward part is tilted upward, it is defined as "down". In addition, the robot can rotate around the Z axis. In the forward direction of the robot, when the robot tilts to the right side of the X axis, it is defined as "right turn", and when the robot tilts to the left side of the X axis, it is defined as "left turn".

The dust cartridge is mounted in a receiving chamber by means of buckle and handle. When the handle is pulled, the buckle shrinks. When the handle is released, the buckle extends to a recess of the receiving chamber.

The specific structure of the first cleaning subassembly 2 and the main body 1 will be described in detail below.

The first cleaning subassembly 2 is mounted on the main body 1 by a guiding member. When the first cleaning subassembly 2 is mounted on the main body 1, the first cleaning subassembly 2 is movable up and down with respect to the main body 1. That is, a gap exists between the first cleaning subassembly 2 and the main body 1.

Specifically, the first cleaning subassembly 2 is provided on the chassis 11 of the main body 1. The chassis 11 is provided with a protrusion structure 113 for mounting the first cleaning subassembly 2. In the embodiments, the first cleaning subassembly 2 is provided on the chassis 11 at the backward part 14 of the main body 1.

The first cleaning subassembly 2 is mounted to the chassis 11 through a guiding member, and the first cleaning subassembly 2 is in clearance fit with the chassis 11.

As shown in FIG. 3 to FIG. 10, the guiding member may include a first guiding ridge 311 and a first guiding groove 111. The first guiding groove 111 is defined on one of the first cleaning subassembly 2 and the chassis 11. The first guiding ridge 311 is provided on the other of the first cleaning subassembly 2 and the chassis 11.

In the illustrated embodiments, the first guiding groove 111 is defined on the side wall of the protrusion structure 113 of the chassis 11. The first guiding ridge 311 is provided on the liquid container 3 of the first cleaning subassembly 2. When the liquid container 3 is engaged with the chassis 11, the first guiding ridge 311 plugs into the first guiding groove 111 to realize the guiding and stop action. As illustrated in FIG. 0.11, in order to make way of the protrusion structure 113 on the chassis 11, the liquid container 3 defines a recess.

Optionally, in order to facilitate the installation of the liquid container 3, the thickness of the first guiding ridge 311 is smaller than the width of the first guiding groove 111. Wherein, the width of the first guiding groove 111 refers to the width between the opposite side walls of the first guiding groove 111, i.e., the vertical distance between the two opposite side walls when the robot is in the horizontal position. After the first guiding ridge 311 is plugged into the first guiding groove 111, the first guiding ridge 311 has a distance between the opposite side walls of the first guiding groove 111. A clearance fit structure between the liquid container 3 and the chassis 11 is formed to facilitate the user to install the liquid container 3.

The width of the gap between the liquid container 3 and the chassis 11 can be determined as desired. In the present embodiments, the width of the gap between the liquid container 3 and the chassis 11 is in the range of 1.5 mm to 4 mm. Optionally, the gap between the liquid container 3 and the chassis 11 is 2 mm. The gap provides a space for the insertion action when the user plugs the liquid container 3 into the chassis 11 without overturning the robot. The user can smoothly mount the liquid container 3 to the chassis 11 not required to strictly align the liquid container 3 with the chassis 11. The current mopping robot, usually needs to be overturned (i.e., bottom up) by the user, and then the tank can be installed, on the one hand, the user is inconvenient to use and install, on the other hand, if the tank leaks, the water easily leaks into the interior of the robot, causing the robot to damage.

In the present embodiment, the first cleaning subassembly 2 is mounted to the main body 1 in the forward direction or the backward direction of the main body 1 and then connected to the main body 1 through a connecting member. The connecting member may include a first connecting member provided on the main body 1 and a second connecting member provided on the first cleaning subassembly 2.

Optionally, in order to facilitate control of the connection and separation of the first cleaning subassembly 2 from the main body 1, autonomous cleaning robot may further include a connection control assembly. The connection control assembly is connected to the first connecting member or the second connecting member and control the connection and separation of the second connecting member and the first connecting member.

Preferably, the connection control assembly is provided on the first cleaning subassembly 2.

In the embodiments, the connecting member is a buckle structure. The liquid container 3 is connected to the chassis 11 through the buckle structure. The buckle structure is not only easy to be installed, but also reliable. Of course, in other embodiments, the connecting member may be other structures, such as a magnetic structure. The liquid container 3 may be connected to the chassis 11 by other means, such as magnetic connection. Correspondingly, the connection control assembly may be a catching control system or a magnetic control system, to ensure that users can easily install and remove.

The details will be described in detail with respect to the specific embodiment in which the liquid container 3 and the chassis 11 are connected by a buckle structure.

Figure 7:
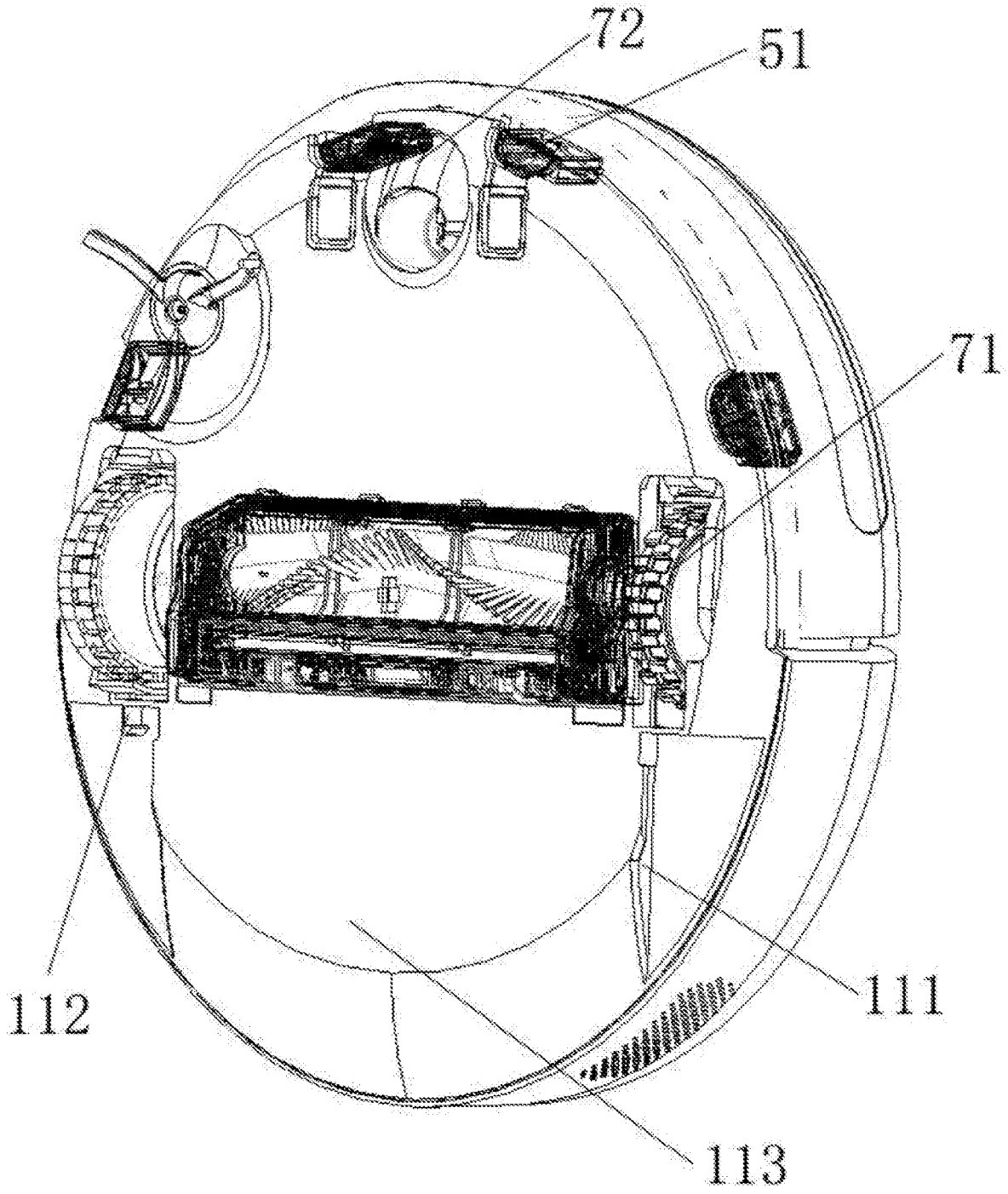
FIG. 7 illustrates a bottom schematic view of a main body of an autonomous cleaning robot, in accordance with embodiments of the present disclosure.
Figure 8:
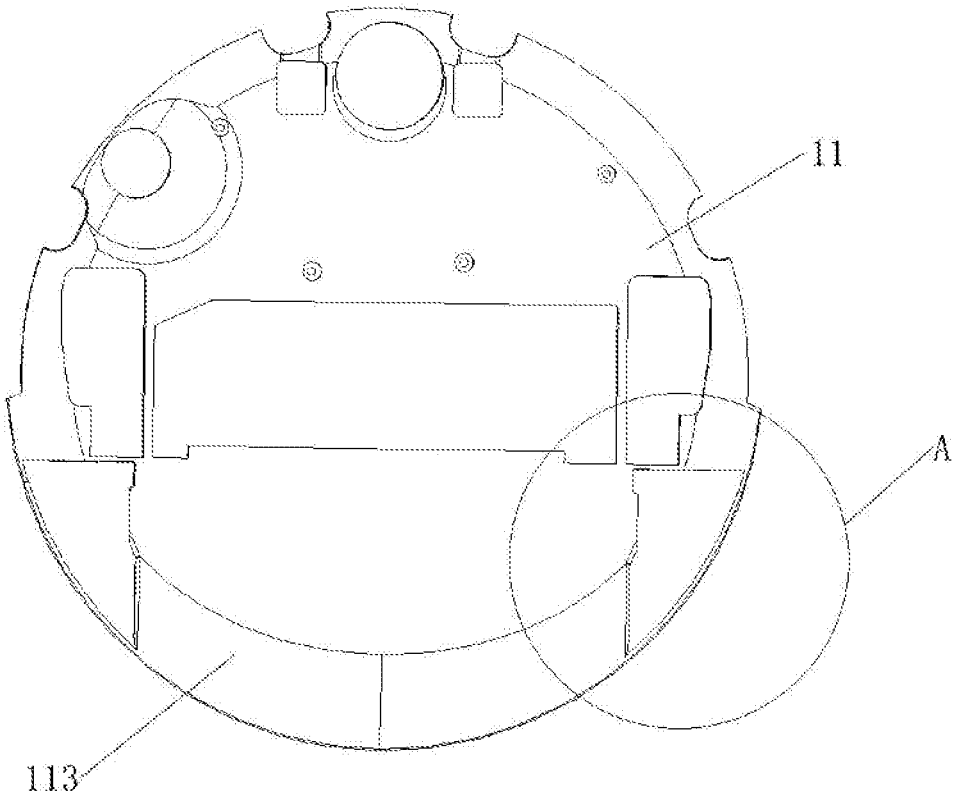
FIG. 8 illustrates a bottom view of a chassis of a main body of an autonomous cleaning robot, in accordance with embodiments of the present disclosure.
Figure 9:
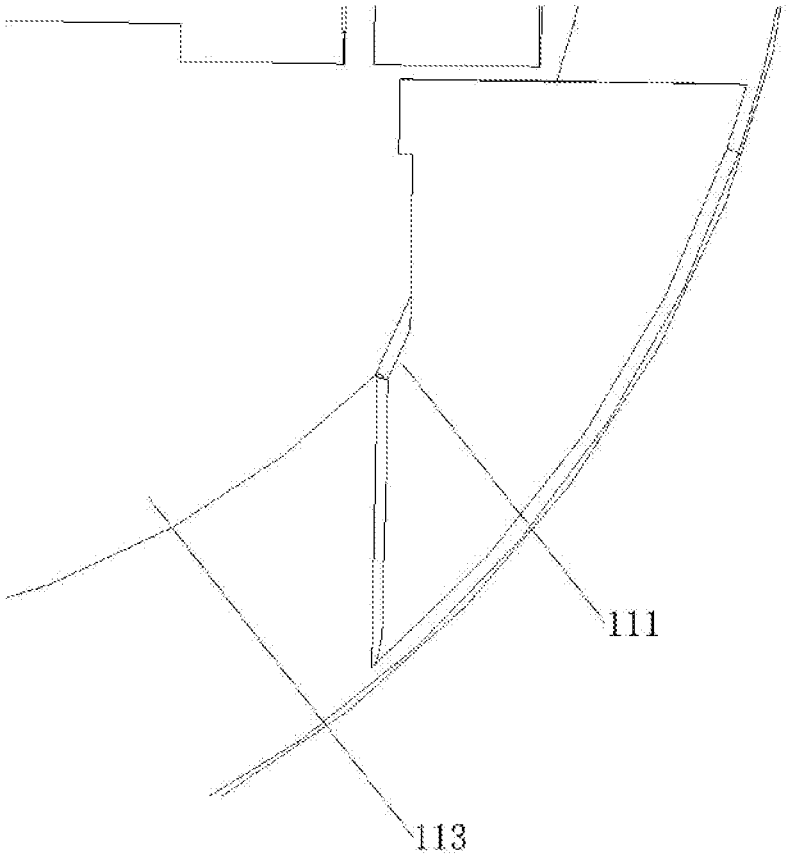
FIG. 9 is a partial enlarged view of A in FIG. 8.
Figure 10:
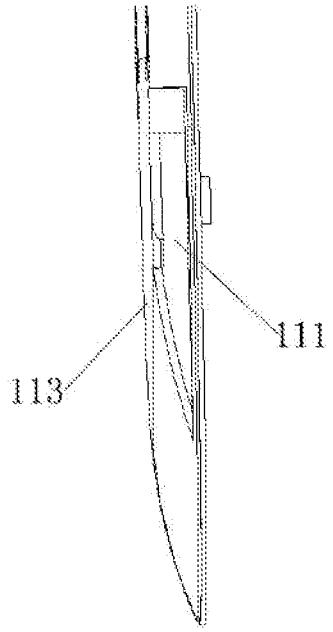
FIG. 10 illustrates a side view of a first guiding groove one the chassis of the main body of an autonomous cleaning robot, in accordance with embodiments of the present disclosure.
Figure 11:
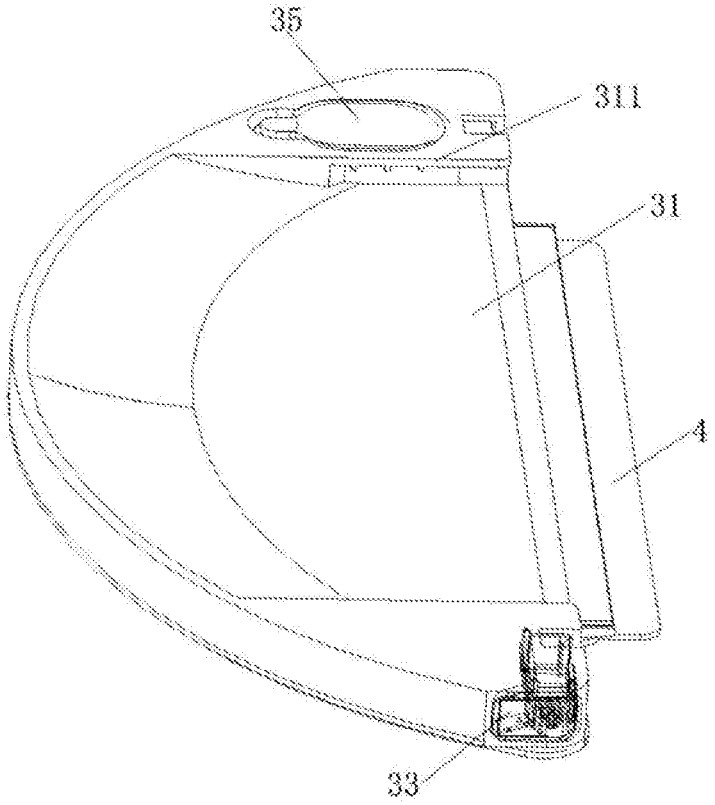
FIG. 11 illustrates a schematic view of a first view of a first view of a liquid container of an autonomous cleaning robot, in accordance with embodiments of the present disclosure.
Figure 12:
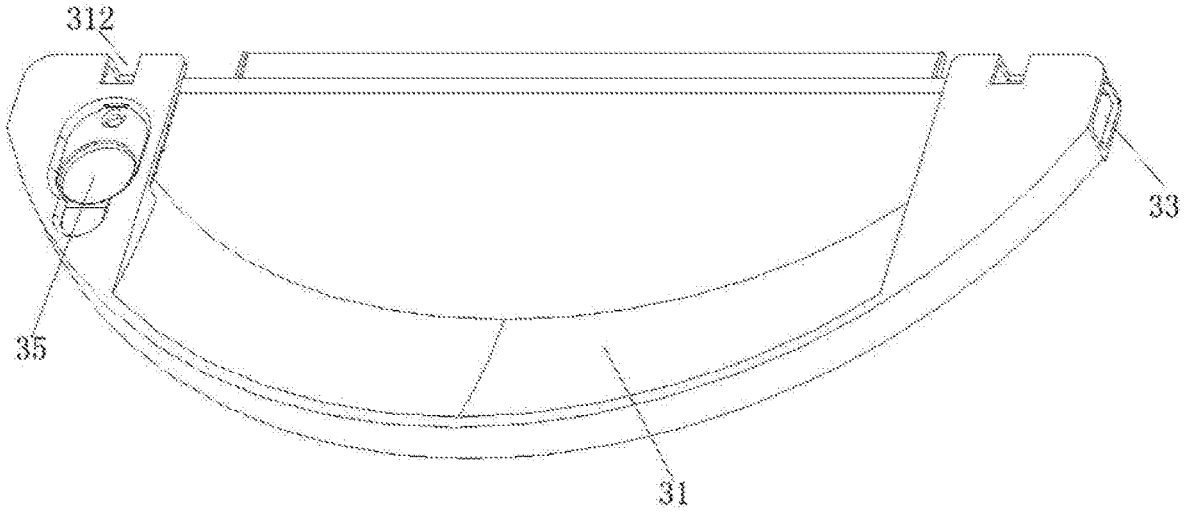
FIG. 12 illustrates a schematic view of a second view of a liquid container of the autonomous cleaning robot, in accordance with embodiments of the present disclosure.
Figure 13:
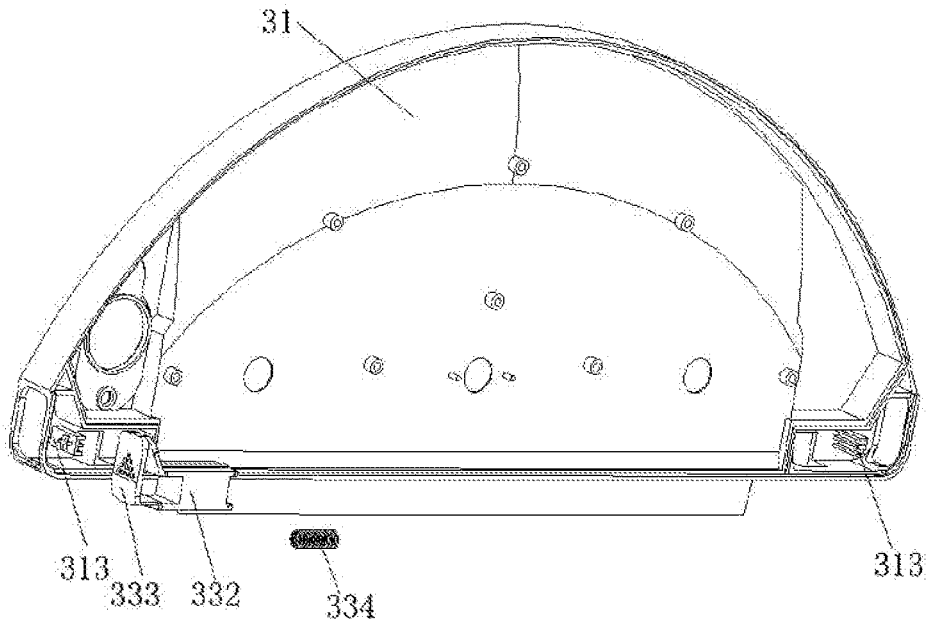
FIG. 13 illustrates a schematic view of a first view of an upper cover and an engagement control subassembly of a liquid container of an autonomous cleaning robot, in accordance with embodiments of the present disclosure.
Figure 14:
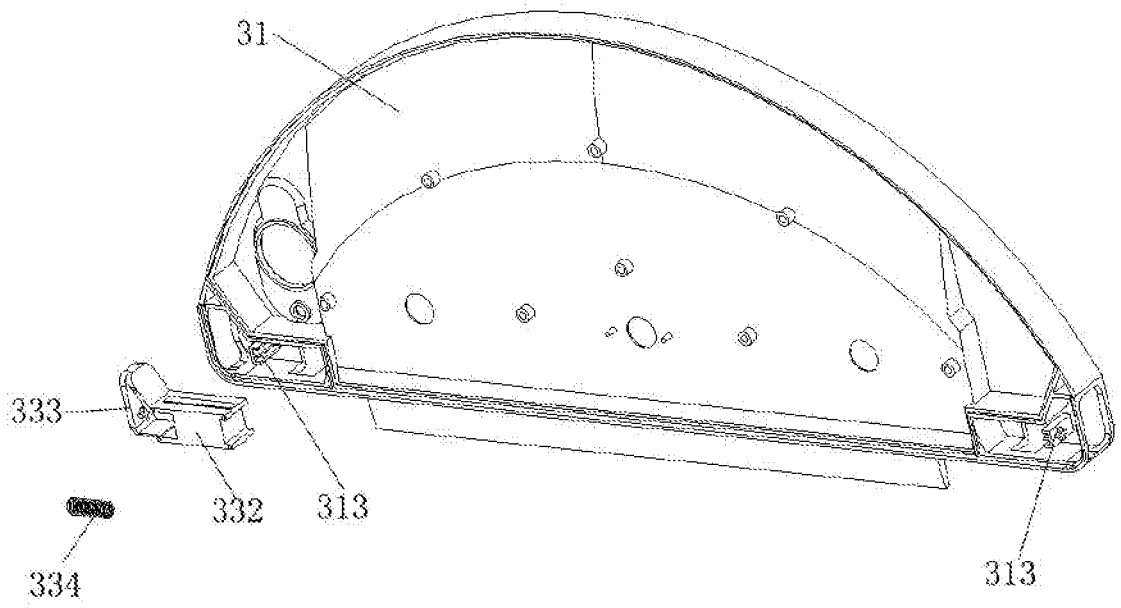
FIG. 14 illustrates an explosion view of a second view of an upper cover and an engagement control subassembly of a liquid container of an autonomous cleaning robot, in accordance with embodiments of the present disclosure.
Figure 15:
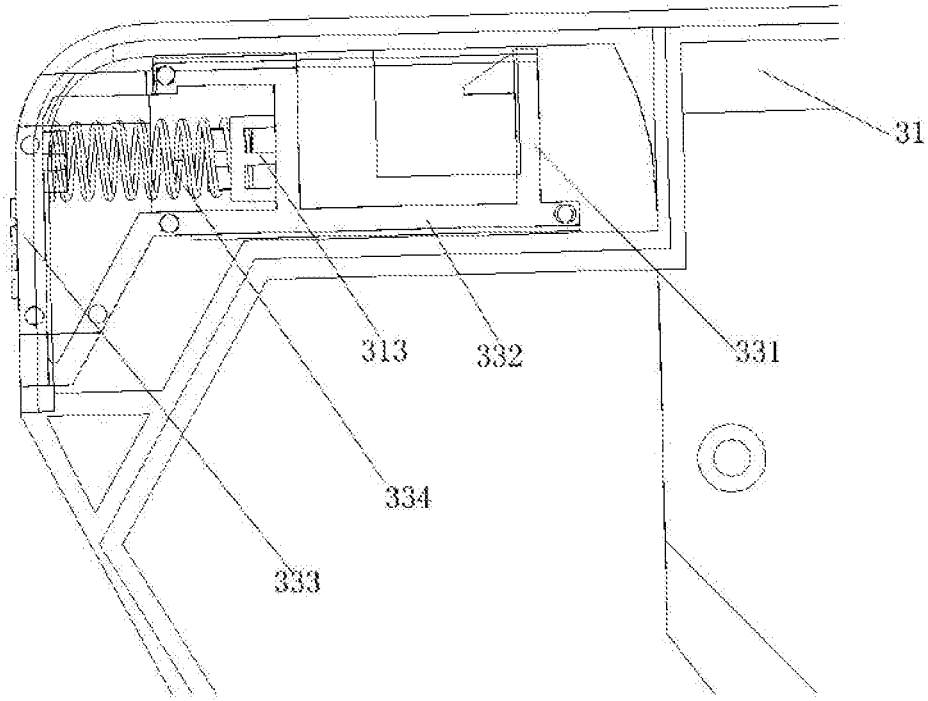
FIG. 15 illustrates a schematic view of the upper cover and the engagement control subassembly fit of a liquid container of an autonomous cleaning robot, in accordance with embodiments of the present disclosure.
Figure 16:
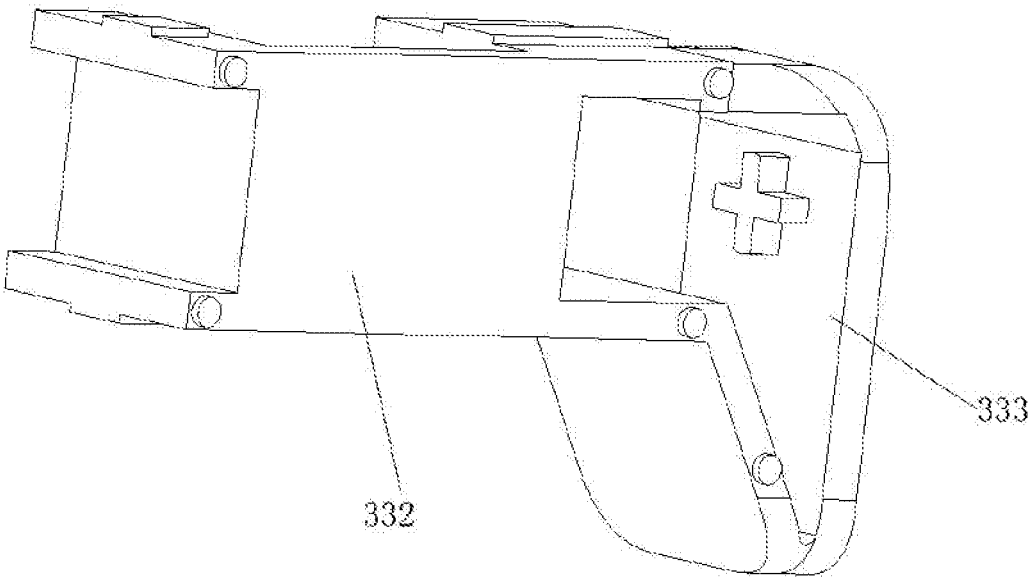
FIG. 16 illustrates a schematic view of a first view of a mounting frame of an engagement control subassembly of an autonomous cleaning robot, in accordance with embodiments of the present disclosure.
Figure 17:
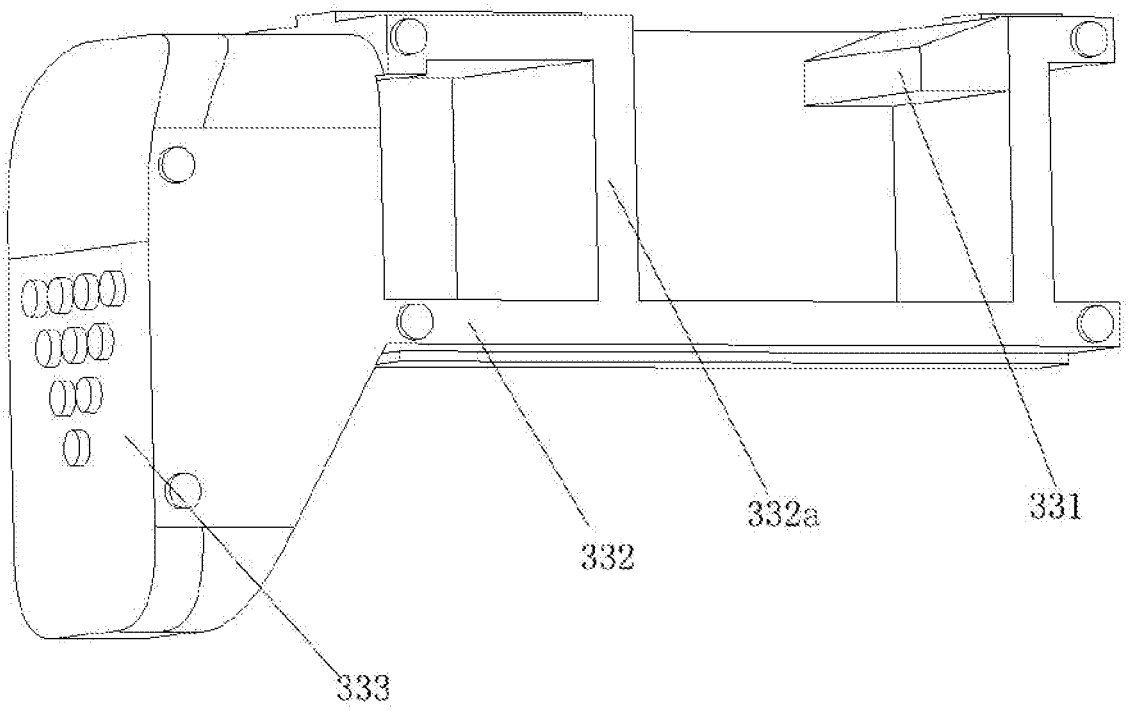
FIG. 17 illustrates a schematic view of a second view of a mounting frame of an engagement control subassembly of an autonomous cleaning robot, in accordance with embodiments of the present disclosure.
Figure 18:
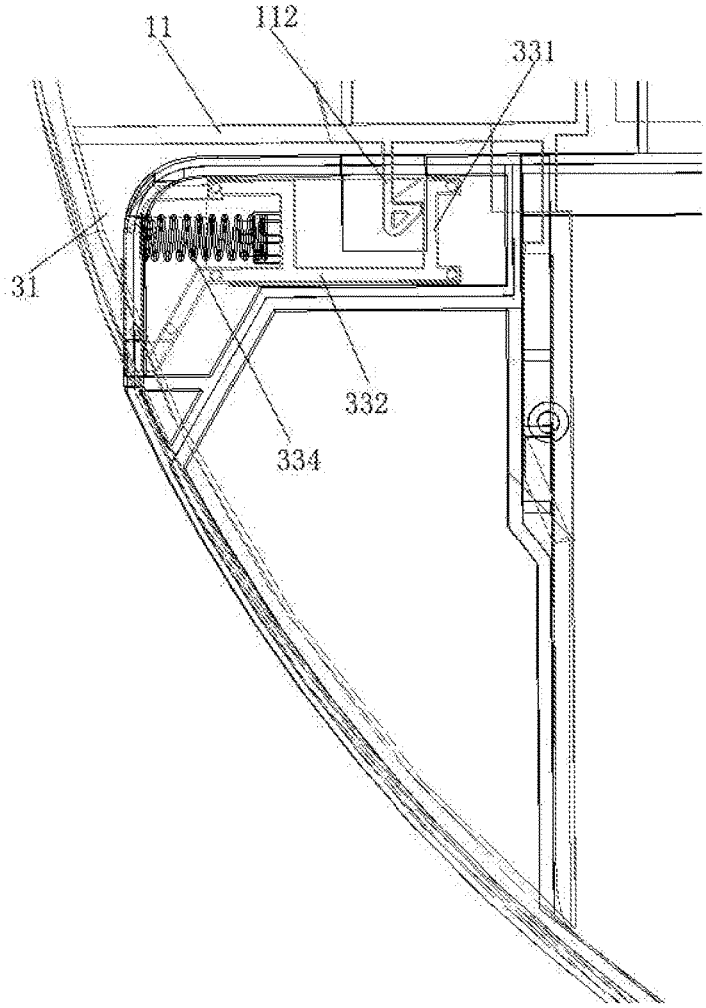
FIG. 18 illustrates a schematic view of the structure of the engagement control member, the first buckle and the second buckle fit of the autonomous cleaning robot, in accordance with embodiments of the present disclosure.
Figure 19:
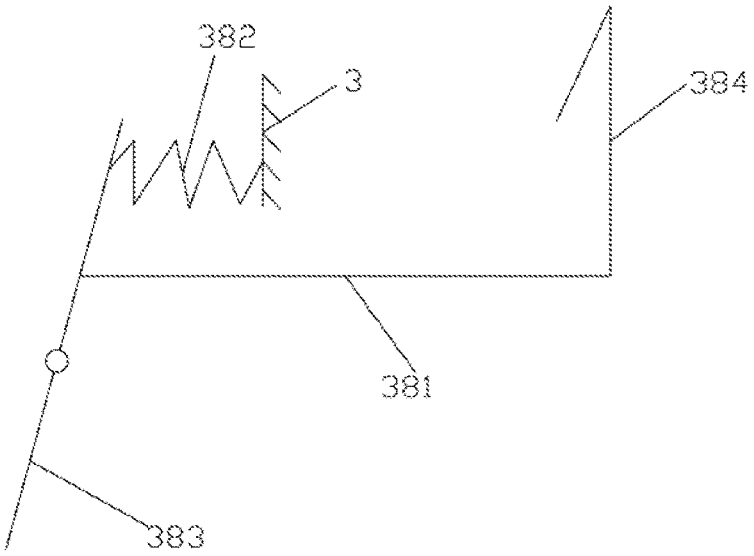
FIG. 19 illustrates a schematic view of another engagement control subassembly of an autonomous cleaning robot, in accordance with embodiments of the present disclosure.
Figure 20:
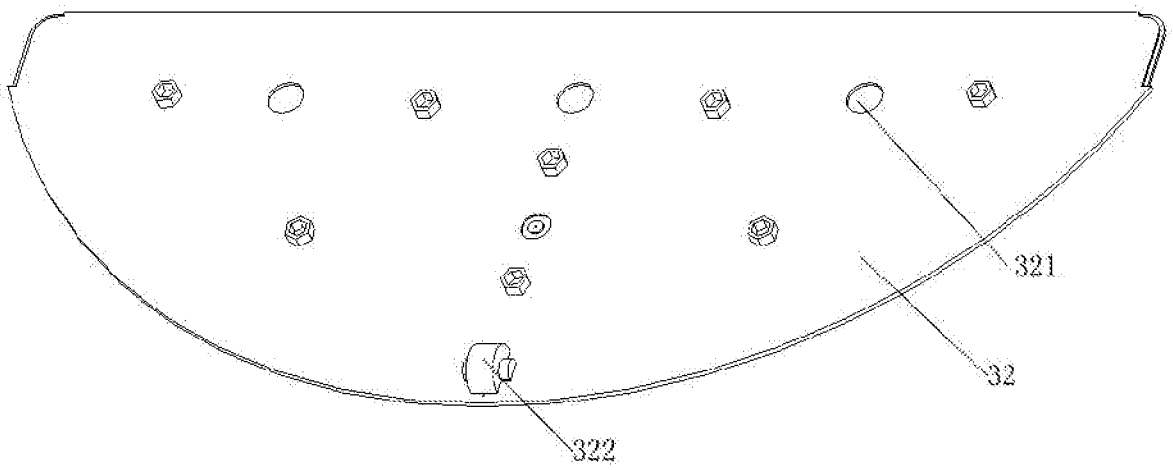
FIG. 20 illustrates a schematic view of a first view of a lower cover of a liquid container of an autonomous cleaning robot, in accordance with embodiments of the present disclosure.
Figure 21:
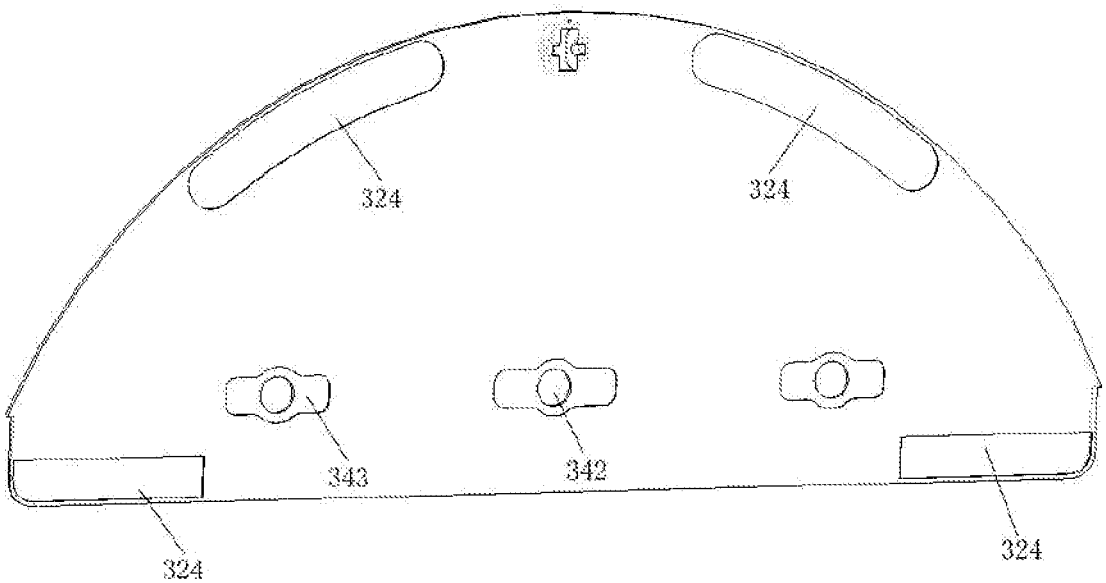
FIG. 21 illustrates a schematic view of a second view of a lower cover of a liquid container of an autonomous cleaning robot, in accordance with embodiments of the present disclosure.
Figure 22:
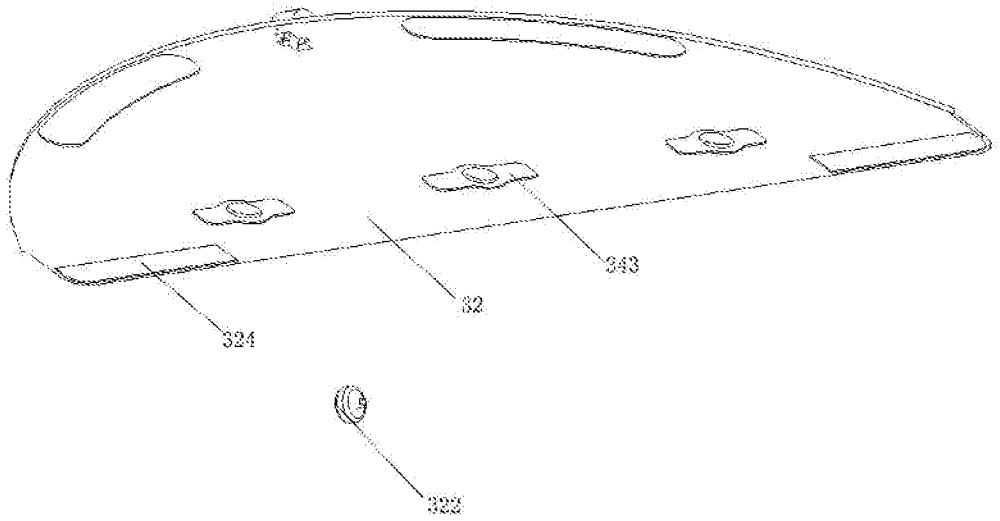
FIG. 22 illustrates a schematic view of a third view of a lower cover of a liquid container of an autonomous cleaning robot, in accordance with embodiments of the present disclosure.
Figure 23:
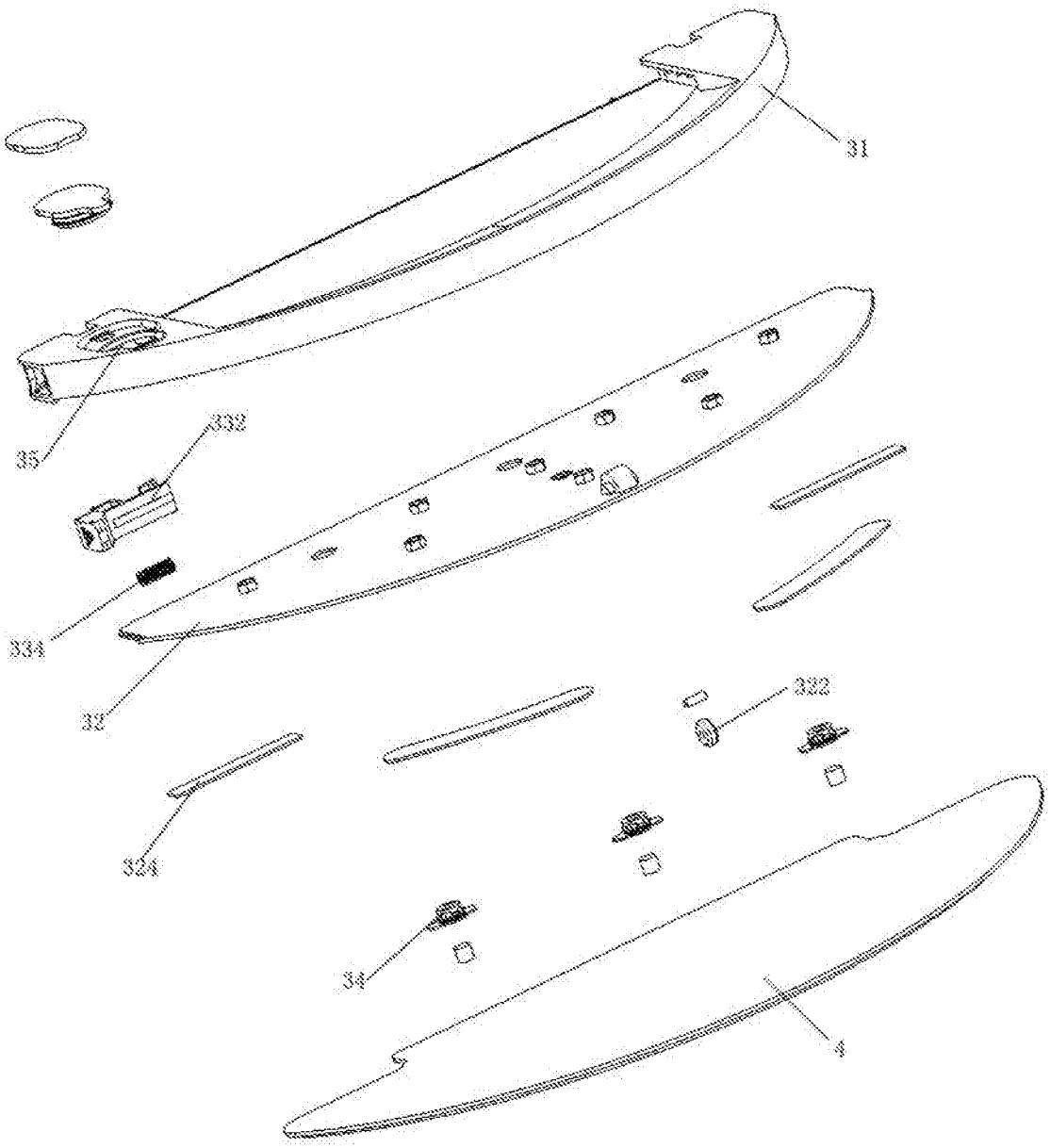
FIG. 23 illustrates a schematic view of a liquid container of an autonomous cleaning robot, in accordance with embodiments of the present disclosure.

Referring to FIG. 7, the chassis 11 is provided with a first connecting member. The first connecting member may be a first buckle 112 or an electromagnet or a magnetic conductor and so on. Taking the first buckle as an example, the first buckle 112 is configured to couple with the liquid container 3 to realize the fixing of the liquid container 3. Referring to FIG. 11 to FIG. 17, the liquid container 3 is provided with the second connecting member. The connecting member may be a second buckle 331 cooperated with the first buckle 112 or an electromagnet or a magnetic conductor. The first buckle 112 and the second buckle 331 cooperatively constitute the connecting member. The second buckle 331 defines a stop position and an avoiding position. As shown in FIG. 18, at the stop position, the second buckle 331 and the first buckle 112 are stopped from each other, and the liquid container 3 is connected to the chassis 11. At the avoiding position, the second buckle 331 is separated from the first buckle 112, and the liquid container 3 can be detached from the chassis 11.

In order to control the engagement and separation of the first buckle and the second buckle 331, the connection control assembly may include an engagement control member 33. The engagement control member 33 controls the position of the second buckle 331, to make the second buckle engaged with or separated from the first buckle 112. In used, the user can control the engagement control member 33 to control the position of the second buckle 331. That is, the liquid container 3 and the chassis 11 may be engaged or separated, to facilitate the loading or removal of the liquid container 3.

Specifically, an upper cover 31 of the liquid container 3 defines a recess for mounting the engagement control member 33 and the second buckle 331. The engagement control member 33 is provided in the upper cover 31. The upper cover 31 defines an opening for the first connecting member inserting thereinto and first connecting member cooperating with the second connecting member.

Additionally, the liquid container 3 includes the container case, the upper cover 31, and a lower cover 32. The container case defines a liquid accommodating room. In the embodiments, the liquid placed in the liquid container is water. Of course, in other embodiments, the liquid container may contain any other cleaning solution as required.

As illustrated in FIG. 0.14 to FIG. 0.17, one of the engagement control assemblies may include a mounting frame 332, an operating member 333 and an elastic piece 334.

The second buckle 331 is fixedly mounted on the mounting frame. The mounting frame is movably disposed within the container case, and can drive the second buckle 331 to the stop position or avoiding position. The operating member is mounted on the mounting frame, and is integrally formed with the mounting frame 332. When the user presses the operating member 333, the operating member 333 drives the mounting frame 332 and the second buckle 331 thereon to move together.

The elastic piece 334 is provided between the operating member 333 and the container case of the liquid container 3 to ensure that the second buckle 331 can be back to the stop position after the pressing force is lost, thereby ensuring that the liquid container 3 can connect with the chassis 11 reliably. The elastic piece 334 may be a structure which can provide an elastic force, such as a spring, an elastic rubber or the like. A first end of the elastic piece 334 abuts against the operating member 333 or the mounting frame 332. The second end of the elastic piece 334 abuts against the container case. And the direction of expansion and contraction of the elastic piece coincides with the moving direction of the mounting frame. In the condition of no press, the elastic force of the elastic piece 334 causes the second buckle 331 to be held in the stop position. When the user needs to remove the liquid container 3, the user presses the operating member 333 to move the second buckle 331 to the avoiding position, the first buckle 112 and the second buckle 331 on the chassis 11 are separated from the stopper, and then the liquid container 3 can be successfully removed.

As illustrated in FIG. 0.13, a stop protrusion 313 is provided on the container case of the liquid container. The mounting frame 332 defines a hole for the protrusion extending in. The stroke of the mounting frame 332 can be defined by fitting the stopper projection 313 and the hole wall 332*a* of the hole. Thus, the mounting frame 332 can be limited, the mounting member 332 can be released from the liquid container 3 without the pressing force due to the elastic force of the elastic piece 334.

In the embodiments, the first end of the elastic piece 334 abuts against the operating member 333. The second end of the elastic piece abuts against the stop protrusion 313. The operating member 333 and the stop protrusion 313 are provided with a cross-convex post for mounting the elastic piece 334.

The specific process of loading the liquid container 3 into the chassis 11 is as follows:

As illustrated in FIG. 0.3 and FIG. 0.4, the liquid container 3 is plugged into the rear portion of the chassis 11 along the first guiding groove 111 on the chassis 11 to form an overall appearance of the autonomous cleaning robot. The chassis 11 of the robot has a first connecting portion. In some specific embodiments, the first connecting may be a hook. The hook can connect with a second connection portion of the liquid container.

In some specific embodiments, the second connection portion may be a buckle. So that the liquid container can be fixed to the bottom of the main body 1. The first guiding groove 111 may be a U-shaped groove, and can be slid with the first guiding ridge 311 on the liquid container to guide the liquid container 3 to slide on the chassis 11.

In the natural state, the second buckle 331 is in the recess of the liquid container 3. When the liquid container 3 is slid into the mating position along the first guiding groove 111 on the chassis 11, the first buckle 112 (hook) on the chassis 11 abuts against the second buckle 331 so that the second buckle 331 moves toward a region other than the recess. The first buckle 112 (hook) can slide into the recess along the slope on the second buckle 331 when the force is applied to a certain extent. Then the second buckle 331 is engaged with the first buckle 112 (hook) so that the liquid container 3 is fixed on the chassis 11. After the liquid container 3 being mounted on the chassis 11, when the fix needs to be released, the operating member 333 of the engagement control member 33 can be pressed with overcoming the spring resistance. The second buckle 331 may be retracted in the liquid container 3 by the force transmission. Then the engagement between the first buckle 112 (hook) and the second buckle 331 may disappear, and the liquid container can be pulled out from the backward direction of main body 1 to realize the unloading of the liquid container 3.

In another engagement control member (not shown), the engagement control member includes a connecting rod 381, a spring 382, a toggle piece 383, and a buckle 384. The buckle 384 is configured to cooperate with the first buckle 112 to connect the connection of the liquid container 3 and the chassis 11. The connecting rod 381 is provided in the liquid container 3. The first end of the connecting rod 381 is provided with the buckle 384, and the second end of the connecting rod 381 is provided with the toggle piece 383. The toggle piece 383 is rotatable provided in the liquid container 3. A first end of the toggle piece 383 is connected with the spring 382, a second end of the toggle piece 383 is an operating end for operating. The spring 382 is connected between the toggle piece 383 and the liquid container 3. The schematic view of the engagement control member is shown in FIG. 0.19.

As shown in FIG. 0.20 to FIG. 0.23, the upper cover 31 of the liquid container 3 is further provided with a water injection port 35 for injecting liquid into the liquid accommodating room. The water injection port 35 is provided with a water injection plug and a water injection cap to seal the water injection port 35.

The lower cover 32 of the liquid container 3 is also provided with a water outlet 321, the water outlet 321 communicates with the liquid accommodating room, and the outlet 321 is removable provided with a water outlet filter 34 for controlling the amount of water.

On the one hand, the lower cover 32 cooperates with the upper cover 31 to form the container case and surrounds the liquid accommodating room for accommodating the liquid. On the other hand, the lower cover is configured to mount the cleaning cloth 4. A plurality of adhesive structures 324 are fixed to one side of the lower cover 32 remoting from the upper cover 31. The cleaning cloth 4 is laid on the side of the lower cover 32 far away from the upper cover 31 and is attached to the lower cover 32 by the adhesive structure. The adhesive structure 324 may be a double-sided adhesive or a Velcro. In order to facilitate the replacement of the cleaning cloth 4, preferably, the adhesive structure 324 is a Velcro.

Figure 27:
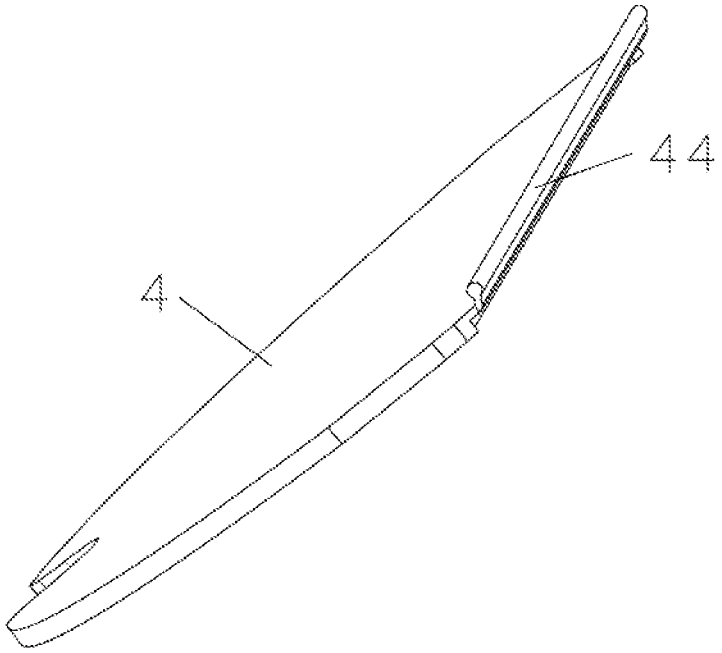
FIG. 27 illustrates a schematic view of a cleaning cloth of an autonomous cleaning robot, in accordance with embodiments of the present disclosure.
Figure 28:
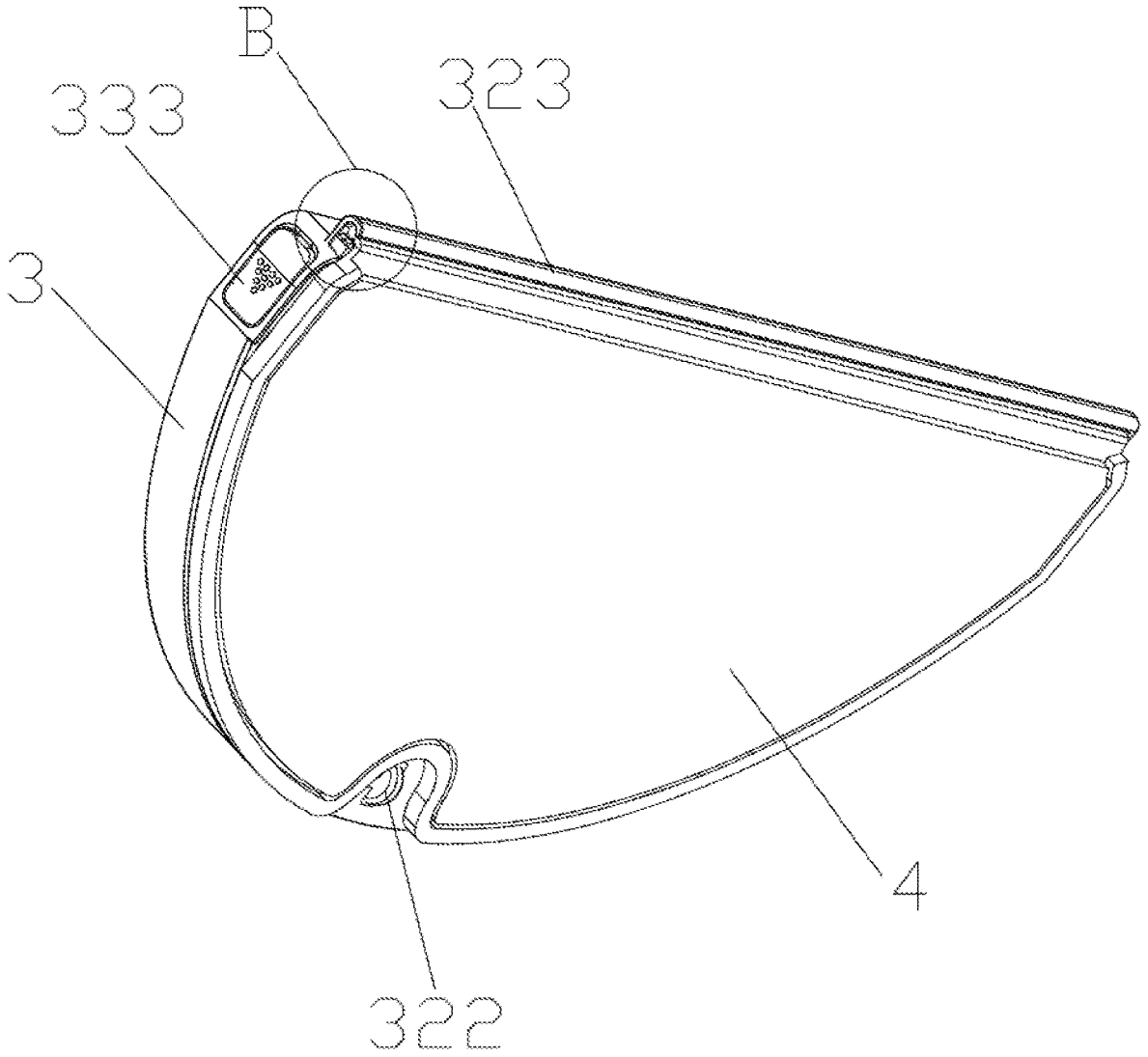
FIG. 28 illustrates a schematic view of a liquid container and a cleaning cloth fit of an autonomous cleaning robot, in accordance with embodiments of the present disclosure.
Figure 29:
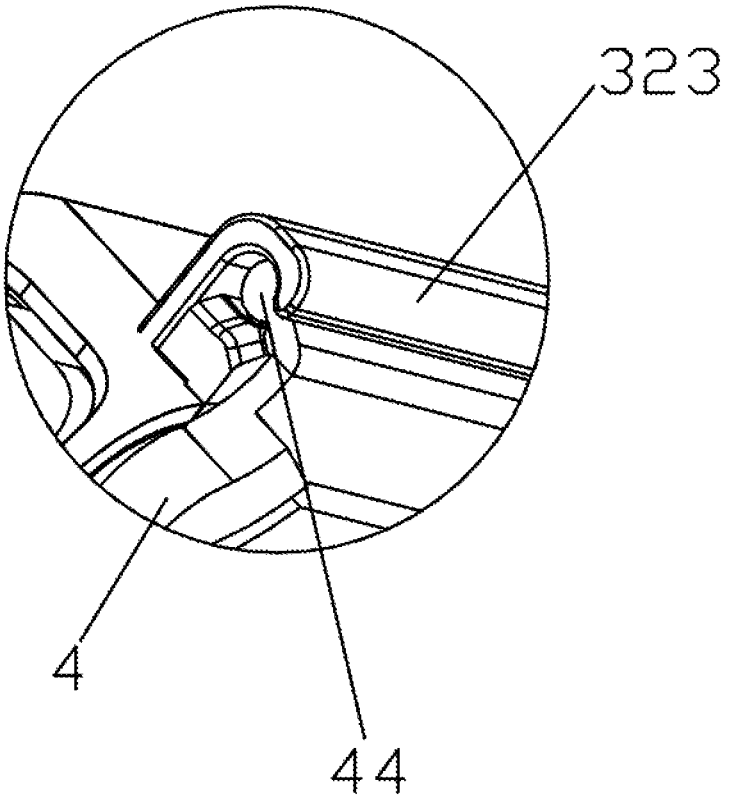
FIG. 29 is a partial enlarged view of B in FIG. 28.

As shown in FIG. 27 to FIG. 29, more preferably, the edge of the cleaning cloth 4 is fixed, to ensure that the direction and position of the cleaning cloth 4 are correct, and the cleaning cloth 4 is prevented from being tilted and affecting the cleaning effect. If using a paste method to fix the cleaning cloth 4, the installation direction of the edge may not be limited and the correct installation of the cleaning cloth 4 cannot be guaranteed. For example, if the cleaning cloth is slant relative to the tank, the cleaning effect will be seriously affected. Therefore, the cleaning cloth 4 is provided with a first guide portion, and the liquid container 3 is provided with a second guide portion, and the first guide portion and the second guide portion can be engaged with each other. So that the cleaning cloth 4 is mounted on the liquid container 3. The first guide portion may be a guiding groove, and the second guide portion may be a guide rod that engages with the guiding groove.

Specifically, a guiding strip 44 is fixedly provided on the side of the cleaning cloth 4 and a mounting groove 323 is provided in the liquid container 3. The guiding strip 44 penetrates into the mounting groove 323 and defines the side of the cleaning cloth 4 on the liquid container 3.

The guiding strip 44 may be a plastic rod or a steel rod having a certain rigidity, or may be a flexible strip. The cross-sectional shape of the guiding strip 44 may be circular or other non-circular shape. The cross-sectional shape of the mounting groove 323 on the liquid container 3 is a C-shape or a shape like the C-shape, just make sure that the guiding strip 44 can be accommodated and defined. The opening (i.e., the opening of the C-shape) of the mounting groove 323 for the cleaning cloth 4 extending is directed downward. One end of the mounting groove 323 is an extending end (the end has no stop structure, which extends into the guiding strip 44) and the other end is a stop end (the end has a stop structure to prevent the guiding strip 44 from coming out of the end). In other words, one end of the mounting groove 323 is closed and the other end is open. The tail portion of the cleaning cloth 4 is fixed to the liquid container 3 by the guiding strip 44 and the mounting groove 323 to improve the fixing stability and prevent the cleaning cloth 4 from falling off. The guiding strip 44 and the mounting groove 323 are located in the liquid container 3 and in the direction of the forward. If the guiding strip 44 is mounted firstly and then the cleaning cloth 4 is adhered to the Velcro, the cleaning cloth can be installed correctly.

As illustrated in FIG. 0.26, the cleaning cloth 4 may be a cleaning cloth made of the same material, or a composite cleaning cloth with different parts thereof made of different materials. In the embodiments, the cleaning cloth is a composite cleaning cloth. The main body of the cleaning cloth is substantially semicircular. An inner layer 43 of the cleaning cloth is a water seepage zone with high permeability material. A middle layer 42 of the cleaning cloth is a decontamination zone with a harder material, and used to scrape off the harder material on the ground. An outer layer 41 of the cleaning cloth is a water absorption zone with better water absorption material, used to absorb the water on the bottom surface and remove the water stains. So the cleaning efficiency is improved. The guiding strip 44 is provided on a semicircular straight-line segment.

The liquid in the liquid accommodating space flows out of the water outlet 321 on the lower cover 32 and wets the cleaning cloth 4. By selecting a filter structure with different material, the amount of the water discharged can be controlled, and the needs of users can be better met.

A barrier-assisting structure is provided on the bottom of the liquid container 3. The obstacle-assisting structure can assist the driving wheel module 71 of the autonomous cleaning robot when the autonomous cleaning robot is climbing or stepping, and provide support for the autonomous cleaning robot in the liquid container 3 to enhance the climbing and obstacle-surmounting capability thereof.

Optionally, the obstacle-assisting structure is an obstacle-assisting wheel for crossing obstacles. The obstacle-assisting wheel 322 is rotatable mounted on the liquid container 3. Specifically, the lower cover 32 of the liquid container 3 is provided with the obstacle-assisting wheel 322, and the obstacle-assisting wheel 322 is rotatable mounted on the lower cover 32. The liquid container 3 is located at the end in the backward direction of the liquid container 3. The cleaning cloth 4 defines an opening at the position corresponding to the obstacle-assisting wheel 322 to avoid the obstacle-assisting wheel 322, so that the obstacle-assisting wheel 322 can be contacted with the ground when necessary.

Correspondingly, the cleaning cloth is provided with a notch, so that the obstacle-assisting wheel 322 can be in contact with the ground. When the autonomous cleaning robot is moved on a horizontal ground, the obstacle-assisting wheel 322 is not in contact with the ground (i.e., when the main body is in the horizontal state, the lowest point of the obstacle-assisting wheel provided on the liquid container is higher than the lowest point of the driving wheel). When the autonomous cleaning robot is tilted on the slope or climbing step, the obstacle-assisting wheel 322 is contact with the ground to form a sliding support point to prevent the main body 1 from being jammed and achieve obstacle crossing. The height of the climbing step of the autonomous cleaning robot can be determined as needed, such as a height of the climbing step is 17 mm, or 19 mm, or higher.

The autonomous cleaning robot of the present disclosure has the following effects:

The connection mode between the liquid container and the main body is the buckle and groove connection. The liquid container is provided with a mounting and connecting structure that can horizontally loading the liquid container into the main body, do not turn the main body upside down. The liquid container can be directly plugged into the chassis of the autonomous cleaning robot horizontally, which greatly facilitate the user to install and disassemble.

The connection mode between the liquid container and the main body is the clearance fit. On one hand, the clearance fit between the liquid container and the main body is convenient for the user to install the liquid container and the main body. If the gap is too small, the liquid container can be inserted only when the gap is precise alignment, which will cause inconvenience for users. If the gap is large enough, the liquid container can be loaded even if the liquid container is inserted with a certain angle. On the other hand, the clearance fit between the liquid container and the main body can improve the robot's ability to obstruct and prevent stuck when encountering obstacles. When the autonomous cleaning robot encounters an obstacle, the liquid container can move up or down to cross the obstacle.

The bottom of the liquid container is provided with the obstacle-assisting wheel. The obstacle-assisting wheel protrudes from the cleaning cloth. The obstacle-assisting wheel contacts the ground when crossing the obstacle. Because the liquid container is in clearance fit with the main body and provided with the obstacle-assisting wheel, the ability to cross the obstacle has greatly improved.

The middle of the liquid container is recessed. Both sides of the liquid container may serve as a water storage department, but also as an installation department, killing two birds with one stone.

The autonomous cleaning robot regulates the rate by way of the water control filter, instead of the water seepage cloth. The water control filter is more convenient to replace, and the rate can be adjusted.

The obstacle-assisting wheel is mounted on the liquid container directly, so that the ability to cross the obstacle of the autonomous cleaning robot has improved.

While the present disclosure has been described in tens of what is presently considered to be the most practical and preferred embodiments, it is to be understood that the present disclosure needs not be limited to the disclosed embodiment. On the contrary, it is intended to cover various modifications and similar arrangements included within the spirit and scope of the appended claims which are to be accorded with the broadest interpretation to encompass all such modifications and similar structures.

What is claimed is:

1. A liquid container comprising: a container case and a water outlet filter, wherein the container case defines a water outlet thereon and a liquid accommodating room therein, the water outlet communicates with the liquid accommodating room, the water outlet filter is plugged into the water outlet and blocks the water outlet, and the water outlet filter is configured to allow the liquid in the liquid accommodating room to pass through, thereby regulating the rate of the liquid dispensed from the liquid accommodating room via a permeation rate of the water outlet filter.

2. The liquid container as claimed in claim 1, wherein the water outlet filter comprises a filter element, the filter element is plugged into the water outlet so as to, block the water outlet.

3. The liquid container as claimed in claim 1, wherein the water outlet filter comprises a filter mounting frame and a filter element, the filter mounting frame is detachably mounted in the water outlet, the filter mounting frame defines a receiving hole, the receiving hole is through the filter mounting frame, and the filter element is detachably filled in the receiving hole.

4. The liquid container as claimed in claim 1, wherein the water outlet filter comprises a stop gasket, the stop gasket is provided on one end of the filter mounting fame.

5. The liquid container as claimed in claim 4, wherein the container case defines a recess thereon, the recess is set around the water outlet, the stop gasket is located in the recess.

6. The liquid container as claimed in claim 3, wherein the filter mounting frame defines a water inlet thereon, the water inlet communicates with the receiving hole and the liquid accommodating room.

7. The liquid container as claimed in claim 6, wherein a plurality of water inlet are defined on the filter mounting frame, the plurality of water inlet are spaced apart from each other in the circumferential direction of the filter mounting frame.

8. The liquid container as claimed in claim 1, further comprising an obstacle-assisting wheel, the obstacle-assisting wheel being rotatably mounted on the container case.

9. The liquid container as claimed in claim 8, wherein the obstacle-assisting wheel protrudes out from the surface of the container case.

10. A autonomous cleaning robot comprising:

a main body;

a cleaning assembly mounted on the main body; wherein the cleaning assembly comprises a first cleaning subassembly detachably mounted on the main body, when the first cleaning subassembly is loaded or removed from the main body, the first cleaning subassembly moves in the forward direction or the backward direction of the main body, the first cleaning subassembly comprises a liquid container; wherein the liquid container comprises a container case, a water outlet filter and an obstacle-assisting wheel, the container case defines a water outlet thereon and a liquid accommodating room therein, the water outlet communicates with the liquid accommodating room, the water outlet filter is mounted on the water outlet, the water outlet filter is configured to regulate the rate of the liquid dispensed from the liquid accommodating room, and the obstacle-assisting wheel is rotatably mounted on the container case.

11. The autonomous cleaning robot as claimed in claim 10, wherein the obstacle-assisting wheel is located at a bottom end of the container case in a backward direction thereof.

12. The autonomous cleaning robot as claimed in claim 10, further comprising a driving wheel module, the driving wheel module comprising a driving wheel rotatable mounted on the main body, wherein when the main body is in a horizontal state, a lowest point of the obstacle-assisting wheel on the liquid container is higher than a lowest point of the driving wheel.

13. The autonomous cleaning robot as claimed in claim 10, wherein the first cleaning subassembly further comprises a cleaning cloth, the cleaning cloth is disposed on a side of the container case, the obstacle-assisting wheel is mounted on the side of the container case, the cleaning cloth defines an opening to expose the obstacle-assisting wheel therefrom.

14. The autonomous cleaning robot as claimed in claim 13, wherein the cleaning cloth is detachably mounted on the liquid container, a first guide portion is provided on the cleaning cloth, a second guide portion is provided on the liquid container, the first guide portion and the second guide portion are engaged with each other to limit an installation direction of the cleaning cloth.

15. The autonomous cleaning robot as claimed in claim 14, wherein the first guide portion comprises a guiding groove, the second guide portion comprises a guide bar engaged with the guiding groove, and the guide bar is configured to plug into the guiding groove to limit the movement of the cleaning cloth relative to the liquid container.

16. The autonomous cleaning robot as claimed in claim 14, wherein the first guide portion comprises a guiding strip, the second guide portion comprises a mounting groove, the guiding strip is configured to plug and be fixed in the mounting groove to limit the movement of the cleaning cloth relative to the liquid container.

17. The autonomous cleaning robot as claimed in claim 16, wherein the guiding strip is fixed to the cleaning cloth by a connecting member, the mounting groove defines a notch therein to avoid the connecting member, a first end of the mounting groove defines an opening thereon, the guiding strip passes through the opening into the mounting groove, the second end of the mounting groove is provided with a stop structure to stop the guiding strip escaping from the mounting groove.

18. The autonomous cleaning robot as claimed in claim 16, wherein the cleaning cloth is semicircular, and the cleaning cloth comprises a water seepage zone, a decontamination zone and a water absorption zone in turn.

19. A liquid container comprising: a container case and a water outlet filter, wherein the container case defines a water outlet thereon and a liquid accommodating room therein, the water outlet communicates with the liquid accommodating room, the water outlet filter is mounted on the water outlet, and the water outlet filter is configured to regulate the rate of the liquid dispensed from the liquid accommodating room;

wherein the water outlet filter comprises a filter mounting frame and a filter element, the filter mounting frame is detachably mounted in the water outlet, the filter mounting frame defines a receiving hole, the receiving hole is through the filter mounting frame, and the filter element is detachably filled in the receiving hole.

20. The liquid container as claimed in claim 19, wherein the container case comprises an upper cover and a lower cover, the upper cover is connected to the lower cover, and the water outlet is provided on the lower cover.

* * * * *